US006745002B2

(12) United States Patent
Nakashima et al.

(10) Patent No.: US 6,745,002 B2
(45) Date of Patent: Jun. 1, 2004

(54) LIQUID-DEVELOPMENT ELECTROPHOTOGRAPHIC APPARATUS

(75) Inventors: Yutaka Nakashima, Kanazawa (JP); Akihiko Inamoto, Uchinada-machi (JP); Shigeki Uesugi, Unoke-machi (JP); Satoru Moto, Kanazawa (JP); Masanari Takabatake, Kanazawa (JP); Motoharu Ichida, Tsubata-machi (JP); Shigeharu Okano, Hakui (JP); Seiichi Takeda, Kanazawa (JP); Tadashi Nishikawa, Tsubata-machi (JP); Satoshi Miyamoto, Hakui (JP); Hitoshi Terashima, Kanazawa (JP); Satoshi Sakai, Kanazawa (JP); Hironaga Hongawa, Uchinada-machi (JP); Masanobu Hongo, Unoke-machi (JP)

(73) Assignee: PFU Limited, Ishikawa (JP)

( * ) Notice: Subject to any disclaimer, the term of this patent is extended or adjusted under 35 U.S.C. 154(b) by 68 days.

(21) Appl. No.: 10/009,982

(22) PCT Filed: Apr. 20, 2001

(86) PCT No.: PCT/JP01/03401

§ 371 (c)(1),
(2), (4) Date: Dec. 12, 2001

(87) PCT Pub. No.: WO01/82003

PCT Pub. Date: Nov. 1, 2001

(65) Prior Publication Data

US 2002/0159801 A1 Oct. 31, 2002

(30) Foreign Application Priority Data

Apr. 21, 2000 (JP) ..... 2000-120250
Apr. 21, 2000 (JP) ..... 2000-120251
Apr. 21, 2000 (JP) ..... 2000-120253
Apr. 21, 2000 (JP) ..... 2000-120254

(51) Int. Cl.[7] ..... G03G 15/20; G03G 15/10; G03G 15/01; G03G 21/00

(52) U.S. Cl. ..... 399/307; 399/250; 399/302; 399/308; 399/348

(58) Field of Search ..... 399/302, 308, 399/247, 357, 348, 250, 307

(56) References Cited

U.S. PATENT DOCUMENTS 5,404,209 A * 4/1995 Matsuoka et al.

(List continued on next page.)

FOREIGN PATENT DOCUMENTS

EP 997792 A1 * 5/2000 ..... G03G/15/11
JP 05-341661 12/1993

(List continued on next page.)

*Primary Examiner*—Susan Lee

(57) ABSTRACT

A liquid-development electrophotographic apparatus utilizes a nonvolatile, high-viscosity, high-concentration liquid toner as a liquid developer. A developing section is in contact with photosensitive drums 11–14, on which an electrostatic latent image is formed, so that the liquid developer is supplied onto photosensitive drums 11-14. Toner particles contained in the liquid developer adhere to the photosensitive drums 11-14 according to an electric field established between the developing section and the photosensitive drums 11-14 to form toner images. The toner images are transferred from the photosensitive drums 11-14 to an intermediate transfer section. A transfer-and-fixation section includes a heater to melt-transfer the toner images onto the printing medium. A development section is disposed at a lower portion of the apparatus to prevent smudging of the printing medium and the intermediate transfer section even when the liquid toner spills.

26 Claims, 10 Drawing Sheets

U.S. PATENT DOCUMENTS

| | | | | | |
|---|---|---|---|---|---|
| 5,519,476 | A | * | 5/1996 | Dalal et al. | 399/307 |
| 5,774,774 | A | | 6/1998 | Tamura et al. | |
| 6,094,556 | A | * | 7/2000 | Tanaka et al. | 399/302 |
| 6,141,524 | A | * | 10/2000 | Berkes et al. | 399/307 |
| 6,173,147 | B1 | * | 1/2001 | Nakashima et al. | 399/308 |
| 6,308,034 | B1 | * | 10/2001 | Nakashima et al. | 399/348 |
| 6,466,756 | B1 | * | 10/2002 | Nakashima et al. | |
| 2002/0159799 | A1 | * | 10/2002 | Kobayashi et al. | 399/302 |

FOREIGN PATENT DOCUMENTS

| | | |
|---|---|---|
| JP | 07-104590 | 4/1995 |
| JP | 07-152265 | 6/1995 |
| JP | 10-186900 | 7/1998 |
| JP | 10-326052 | 12/1998 |
| JP | 11-024423 | 1/1999 |
| JP | 11-065294 | 3/1999 |
| JP | 2000-056575 | 2/2000 |
| WO | 94/23347 | 10/1994 |

* cited by examiner

LIQUID-DEVELOPMENT ELECTROPHOTOGRAPHIC APPARATUS

TECHNICAL FIELD

The present invention relates to a liquid-development electrophotographic apparatus which uses a nonvolatile, high-viscosity, high-concentration liquid toner.

BACKGROUND ART

As an electrophotographic apparatus operating by the steps of generating an electrostatic latent image on a photosensitive body (a photosensitive drum), causing toner to be attracted to the electrostatic latent image, transferring the toner onto paper or the like, and fixing the transferred toner, a dry-type apparatus, which uses a powder toner, is widely used.

However, a powder toner involves the following problems: toner particles scatter; and since toner particles have a relatively large particle size of 7 $\mu$m to 10 $\mu$m, resolution is low.

Thus, when high resolution is required, a liquid-development-type apparatus, which uses a liquid toner, is used for the following reason. A liquid toner has a small toner particle size of about 1 $\mu$m and exhibits a large electrostatic-charge capacity. Thus, a toner image is unlikely to be disturbed, and high resolution can be achieved.

FIG. 13 shows the overall configuration of a conventional liquid-development-type electrophotographic apparatus (disclosed in, for example, Japanese Patent Application Laid-Open (kokai) No. 2000-56575). In FIG. 13, a photosensitive drum 10 is electrostatically charged by means of a charger 21. Subsequently, the photosensitive drum 10 is exposed to light by means of an exposure unit 22, whereby an electrostatic latent image is formed. A prewetting unit 23 applies silicone oil to the surface of the photosensitive drum 10. Reference numeral 26 denotes a blade for scraping off residual development toner, and reference numeral 27 denotes a destaticizer.

Developing units 24 corresponding to yellow, magenta, cyan, and black are provided and use as a liquid developer a nonvolatile, high-viscosity, high-concentration liquid toner. A developing roller supplies the liquid developer onto the photosensitive drum 10 while causing toner particles contained in the liquid developer to adhere to the photosensitive drum 10 according to an electric field established between the same and the photosensitive drum 10.

An intermediate transfer roller 15 transfers color toners one by one from the photosensitive drum 10 according to an electric field established between the same and the photosensitive drum 10. A heating unit 28 heats the surface of the intermediate transfer roller 15 to thereby melt the toners adhering to the intermediate transfer roller 15. Heating by the heating unit 28 is performed after all color toners have been transferred onto the intermediate transfer roller 15. A pressure roller 19 is adapted to fix on a printing medium the toners which are melted on the intermediate transfer roller 15 by means of the heating unit 28.

When the intermediate transfer roller 15 transfers toner particles from the photosensitive drum 10 according to an electric field established between the same and the photosensitive drum 10, there must be removed oil which is composed of excessive prewetting liquid and carrier in a developed toner layer and which, together with toner particles, is transferred from the photosensitive drum 10 to the intermediate transfer roller 15. For effecting the removal, the illustrated apparatus employs an oil-removing roller 25 on the intermediate transfer roller 15.

A carrier solvent to be used in the liquid-development electrophotographic apparatus is intended to prevent scattering of toner particles, which assume a particle size of about 1 $\mu$m, as well as to uniformly disperse toner particles through electrification of the toner particles. In development and electrostatic transfer processes, the carrier solvent serves as a "bridge" to facilitate movement of toner particles, which is effected by means of electric-field action.

In a liquid-development printer process, the carrier solvent is a component necessary for storage of toner, transport of toner, formation of a toner layer, development, and electrostatic transfer of toner. However, during and after the step of fixation of toner on a paper medium, the carrier solvent is a component unnecessary for obtainment of good picture quality. Thus, at present, in many liquid developers (liquid toners) a volatile insulating liquid is used as a carrier solvent. However, a liquid developer which uses a nonvolatile carrier solvent is developed in consideration of fixation of toner within apparatus due to volatilization of a carrier, and effects of a volatile carrier on the human body and the environment. An example of such a liquid developer is an HVS (High-Viscosity Silicone) toner.

In some cases, a liquid-development toner which uses a nonvolatile carrier solvent may involve the following problem: the carrier solvent cannot be volatilized during melting of toner through application of heat to the liquid toner and, particularly during fixation of toner or melt transfer of a toner image, hinders development of adhesion of a molten toner onto a paper medium, resulting in a failure to attain satisfactory picture quality and fixation strength with respect to a toner image transferred onto the paper medium.

In some cases, a system that employs melt transfer of an image formed through superposition of toners from an intermediate transfer body to a paper medium may involve the following problem: a toner image on the intermediate transfer body may become spottedly frizzy during application of heat for melting the toners. This problem is related to the relation among releasability of the surface of the intermediate transfer body, viscosity (fluidity) of molten toners, and wettability of a carrier solvent.

Thus, a nonvolatile carrier solvent must be removed to the greatest possible extent before a step of fixing toner on a paper medium is started. However, before a heating step, a limit is imposed on removal of a carrier solvent filling gaps present among toner particles.

Therefore, a "hot carrier removal" process is effective for removal of a carrier solvent. According to the process, residual carrier trapped in gaps present among toner particles is caused to float on toner particles during melting of toner through application of heat, and the floating carrier is removed. Specifically, in a printer apparatus whose printing operation involves remaining of a nonvolatile carrier solvent within a toner image formed on an intermediate transfer body, the carrier solvent (a liquid component) is separated through utilization of integration of toner particles (a resin component) during melting of toner particles by application of heat as well as through utilization of strong electric-field-induced force of toner particles electrically activated by temperature rise. In application of an electric field to a molten toner in the course of heating, influence of heat on roller members and mutual influence for other process conditions must be considered. However, prior art techniques fail to sufficiently consider these factors in determination of control conditions.

Since color toners are transferred on a single-color basis from the photosensitive drum 10 to the intermediate transfer roller 15, a color toner which has already been transferred onto the intermediate transfer roller 15 passes, before heating, a contact portion between the photosensitive drum 10 and the intermediate transfer roller 15. If the color toner contains excessive prewetting liquid and carrier, the excessive prewetting liquid and carrier are collected and flow at the contact portion between the photosensitive drum 10 and the intermediate transfer roller 15, causing disturbance of an image and affecting heating and melting of a toner layer in the course of fixation. As mentioned previously, the illustrated configuration can remove excessive prewetting liquid or carrier liquid.

However, the illustrated configuration must be such that sufficient cooling is achieved at the contact portion between the photosensitive drum 10 and the intermediate transfer roller 15. From the viewpoint of heat resistance of the photosensitive drum 10, cooling to a temperature of not higher than 60° C. must be achieved at the contact portion. In a liquid-development-type electrophotographic apparatus, in order to transfer toner onto a printing medium and fix the transferred toner on the printing medium, toner on an intermediate transfer body must be melted through application of heat from the heating unit 28; however, before transfer of toner onto intermediate transfer roller 15, the intermediate transfer roller 15 must be cooled, since a molten toner causes defective transfer.

Thus, as shown in FIG. 6, a cooling unit, such as a fan, is used for cooling, and in order to facilitate cooling after melt transfer, image formation is performed on a thin belt, whose thermal capacity is small. However, from the viewpoint of maintenance of strength, the belt cannot be made thinner than about 50 $\mu$m, which is not sufficiently thin for minimization of thermal capacity; i.e., cooling consumes a large amount of energy.

A melt transfer process for fixing toner on a printing medium is desirably such that, when toner particles are transferred onto the medium through contact with the same, the toner particles and the medium assume a temperature equal to or higher than the melting temperature of the toner particles. In the course of the transfer, a backup pressure is applied to the medium from behind so as to bring a molten toner in close contact with the medium. As a result, the molten toner is transferred onto the medium by means of adhesion of the same.

As mentioned previously, before melt transfer onto a printing medium, excessive carrier oil is removed. In this connection, when an image formation surface is made of a material having a strong toner retention force so as to prevent image impairment which would otherwise result from a removing action effected by a removing roller, an image is not impaired, but in the subsequent step of transfer onto the printing medium the efficiency of transfer is impaired. Conventionally, in printing on a sheet requiring transparency, such as an OHP sheet, fixation temperature is set high, and fixation speed is set low, so as to sufficiently melt toner for increasing fluidity of the molten toner, thereby accelerating integration of the molten toner. However, a drop in printing speed results.

In transfer onto a printing medium, pressure is applied to the printing medium while toner is being heated, to thereby transfer the toner onto the medium by means of adhesion of the toner, and, in order to assist the transfer, an electric field is applied (a bias is applied). However, since the optimum intensity of an electric field depends on a printing medium, an expensive variable-bias power supply must be employed in order to change a bias as needed.

DISCLOSURE OF THE INVENTION

An object of the present invention is to provide a liquid-development-type electrophotographic apparatus in which a toner image on an intermediate transfer body is melted through application of heat and the molten toner image is transferred onto and fixed on a printing medium, the apparatus being characterized in that heat is released efficiently from the same and that accidental spilling of a liquid toner is unlikely to smudge the printing medium.

Another object of the present invention is to provide a liquid-development electrophotographic apparatus adapted to efficiently melt toner particles transferred onto an intermediate transfer body and to simultaneously fix the molten toner on a medium, to thereby provide high efficiency, high fixation strength, and a high-quality image.

Yet another object of the present invention is to enable application of an electric field of the optimum intensity to a printing medium while a bias applied to the printing medium is held constant.

Still another object of the present invention is to perform melt transfer onto a printing medium while thermal influence on a photosensitive body is reduced.

Another object of the present invention is to provide a material, a mechanism, and a condition for effectively and stably removing carrier liquid.

Yet another object of the present invention is to perform optimum carrier removal according to the amount of residual carrier.

Still another object of the present invention is to prevent thermal deterioration of a photosensitive drum through shutting off heat transmission to the photosensitive drum.

A further object of the present invention is to efficiently perform heating and cooling without involvement of a drop in real throughput.

A liquid-development electrophotographic apparatus of the present invention comprises a development section using a nonvolatile, high-viscosity, high-concentration liquid toner as a liquid developer, the development section being in contact with an image bearer body, on which an electrostatic latent image is formed, so as to supply the liquid developer onto the image bearer body, and causing toner particles contained in the liquid developer to adhere to the image bearer body according to an electric field established between the development section and the image bearer body to thereby form a toner image; an intermediate transfer section to which the toner image is transferred from the image bearer body according to an electric field established between the same and the image bearer body; and a transfer-and-fixation section including a heater for melting the toner image transferred onto the intermediate transfer section through application of heat at a contact portion between the intermediate transfer section and a printing medium to thereby melt-transfer the toner image onto the printing medium. According to the present invention, the development section is disposed at a lower portion of the apparatus. Thus, accidental spilling of the liquid toner does not smudge the printing medium and the intermediate transfer section.

According to the present invention, the transfer-and-fixation section is disposed at an upper portion of the apparatus, thereby facilitating release of heat from the apparatus and prevention of thermal propagation into the interior of the apparatus.

A liquid-development electrophotographic apparatus of the present invention comprises a development section using a nonvolatile, high-viscosity, high-concentration liquid toner as a liquid developer, the development section being in contact with an image bearer body, on which an electrostatic latent image is formed, so as to supply the liquid developer onto the image bearer body, and causing toner particles contained in the liquid developer to adhere to the image bearer body according to an electric field established between the development section and the image bearer body to thereby form a toner image; an intermediate transfer body to which the toner image is transferred from the image bearer body according to an electric field established between the same and the image bearer body; and a transfer-and-fixation section including a heater for melting the toner image transferred onto the intermediate transfer body through application of heat at a contact portion between the intermediate transfer body and a printing medium to thereby melt-transfer the toner image onto the printing medium. The intermediate transfer body is equipped with a carrier-removing roller which comes into contact with a toner layer forming an image thereon in order to remove excessive oil from the toner layer and to which a bias voltage is applied in such a direction as to press toner particles against the intermediate transfer body retaining an image. A material having low surface energy (e.g., dimethyl silicone rubber) is used as a surface material, serving as an image formation surface, of the intermediate transfer body, and the electric resistance of the surface material is set to a semiconductive range of 1E4-1E12 Ω.

A liquid-development electrophotographic apparatus of the present invention uses a material having low surface energy (e.g., dimethyl silicone rubber) as a surface material, serving as an image formation surface, of an intermediate transfer body, and the electric resistance of the surface material is set to a semiconductive range of 1E4-1E12 Ω. In printing on a sheet requiring transparency, such as an OHP sheet, melt transfer is performed without prior removal of excessive oil, and after melt transfer is performed, excessive oil is removed from the sheet.

A liquid-development electrophotographic apparatus of the present invention comprises a development section using a liquid toner as a liquid developer, the development section being in contact with an image bearer body, on which an electrostatic latent image is formed, so as to supply the liquid developer onto the image bearer body, and causing toner particles contained in the liquid developer to adhere to the image bearer body according to an electric field established between the development section and the image bearer body to thereby form a toner image; an intermediate transfer body to which the toner image is transferred from the image bearer body; and a transfer-and-fixation section for melting the toner image transferred onto the intermediate transfer body through application of heat at a contact portion between the intermediate transfer body and a printing medium to thereby melt-transfer the toner image onto the printing medium. The intermediate transfer body is equipped with an excessive-carrier-removing mechanism having a carrier-removing roller for removing excessive oil from a toner layer that forms an image on the intermediate transfer body. The carrier-removing roller comes into contact with the toner layer heated to not lower than a melting temperature thereof or a temperature near the melting temperature, and a bias voltage is applied to the carrier-removing roller in such a direction as to press toner particles against the intermediate transfer body which retains an image.

A liquid-development electrophotographic apparatus of the present invention may be configured such that the intermediate transfer body comprises an intermediate transfer roller for superposing toner images in a plurality of colors through transfer of the toner images from corresponding image bearer bodies, and an intermediate transfer belt having the superposed toner images transferred thereto at one time from the intermediate transfer roller and melting the superposed toner images through application of heat at a contact portion between the same and a printing medium to thereby melt-transfer the superposed toner images onto the printing medium. Rotation of the intermediate transfer belt is controlled according to the amount of residual carrier on the intermediate transfer belt which retains a heated toner layer.

A liquid-development electrophotographic apparatus of the present invention comprises a development section using a liquid toner as a liquid developer, the development section being in contact with an image bearer body, on which an electrostatic latent image is formed, so as to supply the liquid developer onto the image bearer body, and causing toner particles contained in the liquid developer to adhere to the image bearer body according to an electric field established between the development section and the image bearer body to thereby form a toner image; an intermediate transfer section to which the toner image is transferred from the image bearer body; and a transfer-and-fixation section for melting the toner image transferred onto the intermediate transfer section through application of heat at a contact portion between the intermediate transfer section and a printing medium to thereby melt-transfer the toner image onto the printing medium. The intermediate transfer section comprises an intermediate transfer roller to which the toner image is transferred from the image bearer body according to an electric field established between the same and the image bearer body, and an intermediate transfer belt to which the toner image is transferred from the intermediate transfer roller, the toner image transferred onto the intermediate transfer belt being melt-transferred onto the printing medium.

A liquid-development electrophotographic apparatus of the present invention is configured such that the intermediate transfer section comprises a first intermediate transfer body to which the toner image is transferred from the image bearer body according to an electric field established between the same and the image bearer body, and a second intermediate transfer body to which the toner image is transferred from the first intermediate transfer body, the toner image transferred onto the second intermediate transfer body being melt-transferred onto the printing medium.

BEST MODE FOR CARRYING OUT THE INVENTION

Figure 1:
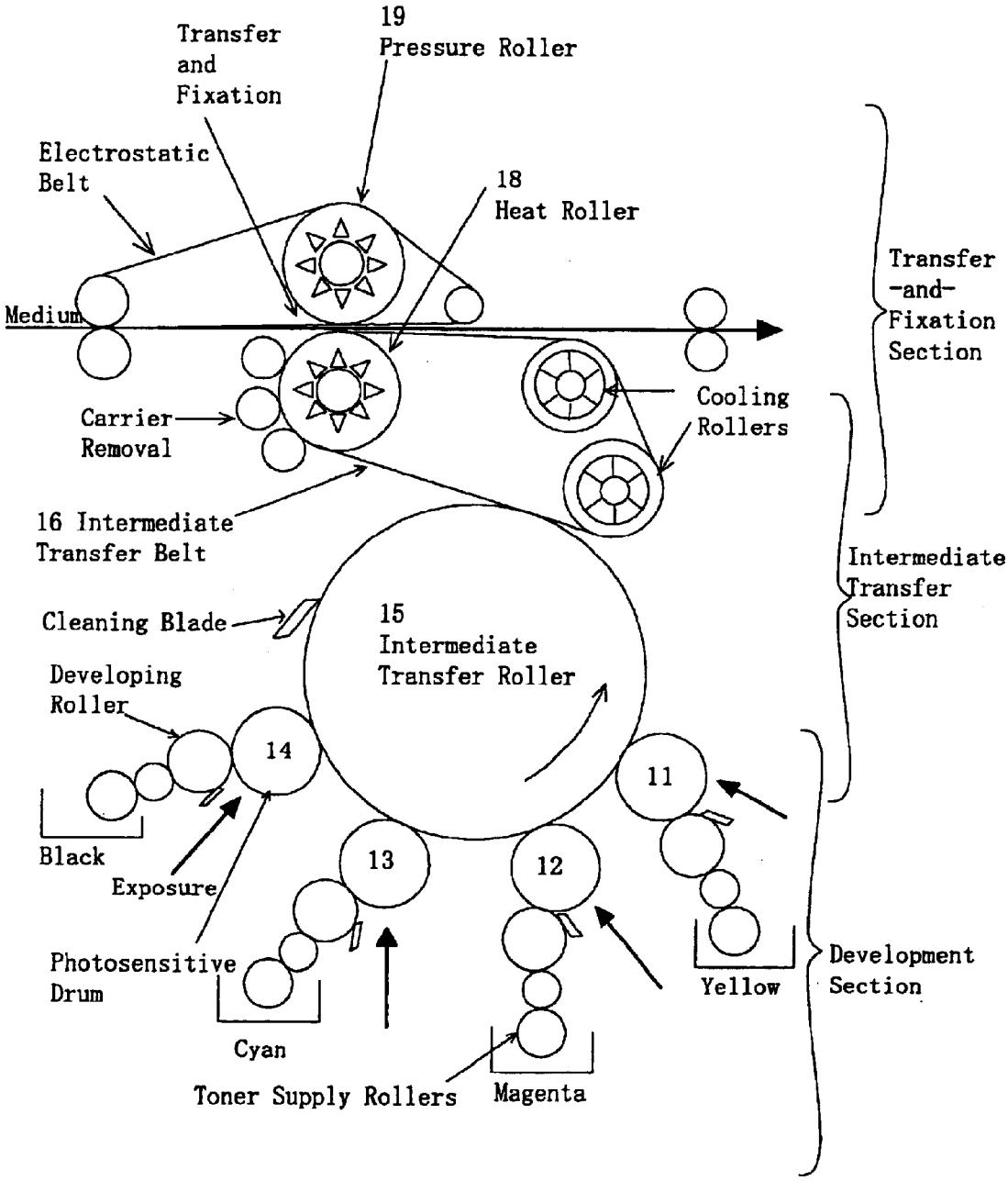
FIG. 1 is a view showing a first configuration example of a liquid-development-type electrophotographic apparatus that embodies the present invention.

Embodiments of the present invention will next be described in detail. FIG. 1 is a view showing a first configuration example of a liquid-development-type electrophotographic apparatus that embodies the present invention. Notably, the present invention uses a nonvolatile, high-viscosity, high-concentration liquid toner as a liquid developer. A liquid toner is composed of a liquid carrier (oil) and solid particles, such as pigment, which are dispersed in the liquid carrier.

As illustrated, the liquid-development electrophotographic apparatus of the present invention includes a development section provided at a bottom portion of the apparatus, an intermediate transfer section disposed above the development section, and a transfer-and-fixation section located at a top portion of the apparatus. The development section includes development subsections corresponding to yellow, magenta, cyan, and black. The development section includes photosensitive drums (photosensitive bodies) 11-14 and chargers (not shown) for electrostatically charging the photosensitive drums 11-14 at about 700 V. The charged photosensitive drums 11-14 undergo exposure as indicated by arrows on the basis of image data by use of, for example, a laser beam having a wavelength of 780 nm. As a result, an electrostatic latent image is formed on each of the photosensitive drums 11-14 such that an exposed portion assumes an electric potential of about 100 V. Also, unillustrated destaticizers are provided for removing residual electric potential from the photosensitive drums 11-14.

Developing rollers are biased at a predetermined voltage of about 400 V-600 V and function to supply positively charged toner to the corresponding photosensitive drums 11-14 according to electric fields established between the same and the photosensitive drums 11-14. Toner adheres to exposed portions, which are charged at about 100 V, on the photosensitive drums 11-14, thereby developing electrostatic latent images on the photosensitive drums 11-14 into respective images. A single or a plurality of toner supply rollers are provided for each color toner. The toner supply rollers convey a liquid toner from a toner fountain to a developing roller while spreading the liquid toner thinner, to thereby apply the liquid toner onto the developing roller at a predetermined layer thickness (e.g., 4–10 $\mu$m). Notably, the liquid toner has a toner viscosity of 100–4000 mPa.S and a carrier viscosity of 20-500 cSt, preferably 100 cSt.

An intermediate transfer roller 15, which serves as a first intermediate transfer body, is biased at about −800 V, whereby toner is transferred onto the intermediate transfer roller 15 from the photosensitive drums 11-14 according to electric fields established between the intermediate transfer roller 15 and the photosensitive drums 11-14. Transfer of toner onto the intermediate transfer roller 15 is sequentially performed, for example, in the following manner: first, transfer of a yellow toner adhering to the first photosensitive drum 11; next, transfer of a magenta toner adhering to the second photosensitive drum 12; then, transfer of a cyan toner adhering to the third photosensitive drum 13; and finally, transfer of a black toner adhering to the fourth photosensitive drum 14. Toner images in four colors developed on the first to fourth photosensitive drums 11-14 are sequentially superposed on the intermediate transfer roller 15 to thereby form a color image. In the course of superposition of four colors, the intermediate transfer roller 15 can be rotated by four rotations, but can also be rotated merely by a single rotation. A cleaning blade comes into contact with the intermediate transfer roller 15 at an appropriate time after transfer of the color image to a second intermediate transfer body and removes residual toner and prewetting liquid from the intermediate transfer roller 15.

Subsequently, the 4-color image is electrostatically transferred onto an intermediate transfer belt 16, which serves as the second intermediate transfer body in the form of a belt. After carrier liquid is removed at a carrier-removing section, the transferred toner image is melted through application of heat at a contact portion between the intermediate transfer belt 16 and a printing medium to thereby be melt-transferred onto the printing medium. An image which is formed on the intermediate transfer belt 16 by means of a liquid toner contains carrier liquid. The carrier oil component is removed from the toner image at the carrier-removing section, which is composed of a plurality of rollers in the illustration. The toner image on the intermediate transfer belt 16 is melted through application of heat by means of a heat roller 18. The resulting molten toner image is transferred onto and fixed on the printing medium by means of a heater-incorporated pressure roller 19, which operates in cooperation with the heat roller 18.

The transfer-and-fixation section includes the pressure roller 19, a plurality of conveyance rollers, an electrostatic belt looped around and mounted on the conveyance rollers, and the intermediate transfer belt 16. The electrostatic belt electrostatically chucks a printing medium to thereby convey the printing medium. Heating by means of the heat roller 18 and the heater-incorporated pressure roller 19 is intended to melt a toner image on the intermediate transfer belt 16 to thereby improve the efficiency of carrier removal and to transfer the resulting molten toner image onto and fix on the printing medium. After transfer and fixation, the thus heated intermediate transfer belt 16 must be cooled. The intermediate transfer belt 16 can be cooled, for example, through cooling rollers (cooling rollers) which the intermediate transfer belt 16 is looped around and mounted on. The intermediate transfer belt 16 is cooled in order to prevent a problem in that when toner is transferred from the intermediate transfer roller 15 to the intermediate transfer belt 16, the toner would otherwise melt with a resultant occurrence of transfer error, as well as to prevent transmission of heat to the intermediate transfer roller 15.

That is, after the intermediate transfer belt 16 is heated to thereby melt a toner image thereon, the intermediate transfer belt 16 must be cooled before a portion of contact with the intermediate transfer roller 15 is reached. The illustrated liquid-development electrophotographic apparatus is configured such that the transfer-and-fixation section, which generates a large amount of heat, is disposed at a top portion of the apparatus. Thus, heat can be efficiently released from inside the apparatus, thereby enhancing the efficiency of cooling the intermediate transfer belt 16.

Furthermore, the illustrated liquid-development electrophotographic apparatus is configured such that the development section, which handles a liquid toner, is disposed at a bottom portion of the apparatus. Thus, even when the liquid toner spills, a printing medium is hardly smudged.

Figure 2:
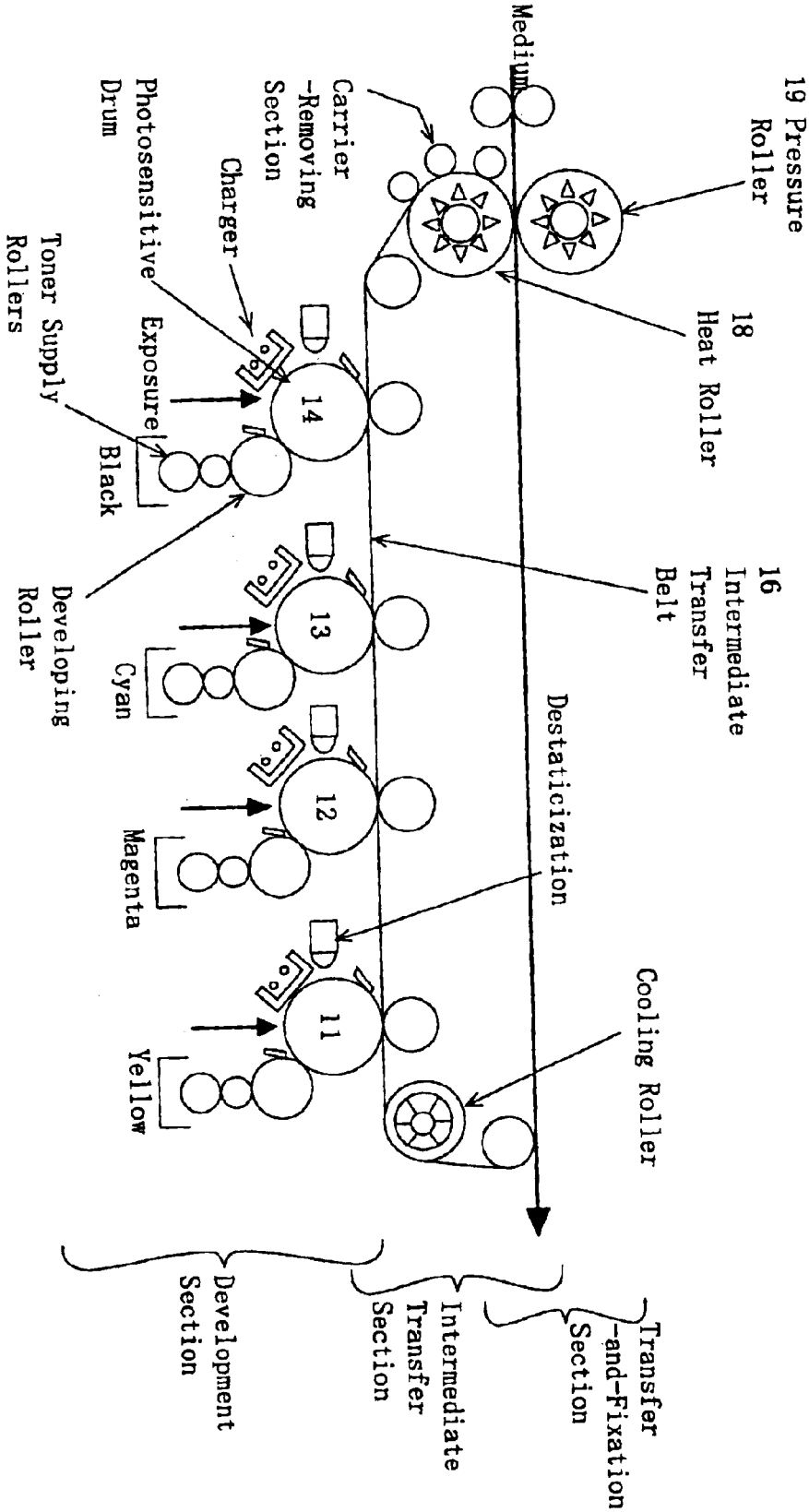
FIG. 2 is a view showing a second configuration example of a liquid-development-type electrophotographic apparatus that embodies the present invention.

FIG. 2 is a view showing a second configuration example of a liquid-development-type electrophotographic apparatus that embodies the present invention. The second configuration example differs greatly from the first configuration example, which has been described with reference to FIG. 1, in that in place of the first and second intermediate transfer bodies, a single intermediate transfer body, which is embodied by the intermediate transfer belt 16, is used.

The illustrated liquid-development electrophotographic apparatus includes a development section provided at a bottom portion of the apparatus, an intermediate transfer section disposed above the development section, and a transfer-and-fixation section located at a top portion of the apparatus. The development section is configured basically in a manner similar to that of FIG. 1 and includes development subsections corresponding to yellow, magenta, cyan, and black. The development section includes photosensitive drums (photosensitive bodies) 11-14, chargers for electrostatically charging the photosensitive drums 11-14, exposure units, and destaticizers.

The intermediate transfer belt 16 serves as an intermediate transfer body. The intermediate transfer belt 16 is biased at about −800 V, whereby toner is transferred onto the intermediate transfer belt 16 from the photosensitive drums 11-14 according to electric fields established between the intermediate transfer belt 16 and the photosensitive drums 11-14. Transfer of toner onto the intermediate transfer belt 16 is performed, for example, in the following manner: first, transfer of a yellow toner adhering to the first photosensitive drum 11; subsequently, at a magenta transfer section for transferring a second toner; i.e., a magenta toner, transfer of the magenta toner adhering to the second photosensitive drum 12; then, transfer of a cyan toner adhering to the third photosensitive drum 13; and finally, transfer of a black toner adhering to the fourth photosensitive drum 14. Toner images in four colors developed on the first to fourth photosensitive drums 11-14 are sequentially superposed on the intermediate transfer belt 16 through a single rotation of the intermediate transfer belt 16, to thereby form a color image.

Subsequently, carrier liquid is removed from the 4-color image at the carrier-removing section. Removal of carrier liquid desirably involve heating. After carrier liquid is removed, the toner image is melted through application of heat at a contact portion between the intermediate transfer belt 16 and a printing medium, followed by melt transfer of the resulting molten toner image onto the printing medium. An image which is formed on the intermediate transfer belt 16 by means of a liquid toner contains carrier liquid. The carrier oil component is removed from the toner image at the carrier-removing section, which is composed of a plurality of rollers in the illustration. The toner image on the intermediate transfer belt 16 is melted through application of heat by means of a heat roller 18. The resulting molten toner image is transferred onto and fixed on the printing medium by means of a pressure roller 19, which has a built-in heater and operates in cooperation with the heat roller 18. The transfer-and-fixation section includes intermediate transfer belt 16, the heat roller 18, and the pressure roller 19.

As in the case of the apparatus shown in FIG. 1, the intermediate transfer belt 16 must repeatedly undergo heating and cooling cycles. As in the case of the apparatus shown in FIG. 1, the liquid-development electrophotographic apparatus shown in FIG. 2 is configured such that the transfer-and-fixation section, which generates a large amount of heat, is disposed at a top portion of the apparatus. Thus, heat can be efficiently released from inside the apparatus, thereby enhancing the efficiency of cooling the intermediate transfer belt 16. Also, as in the case of FIG. 1, the development section, which handles a liquid toner, is disposed at a bottom portion of the apparatus. Thus, even when the liquid toner spills, a printing medium is hardly smudged.

Figure 3:
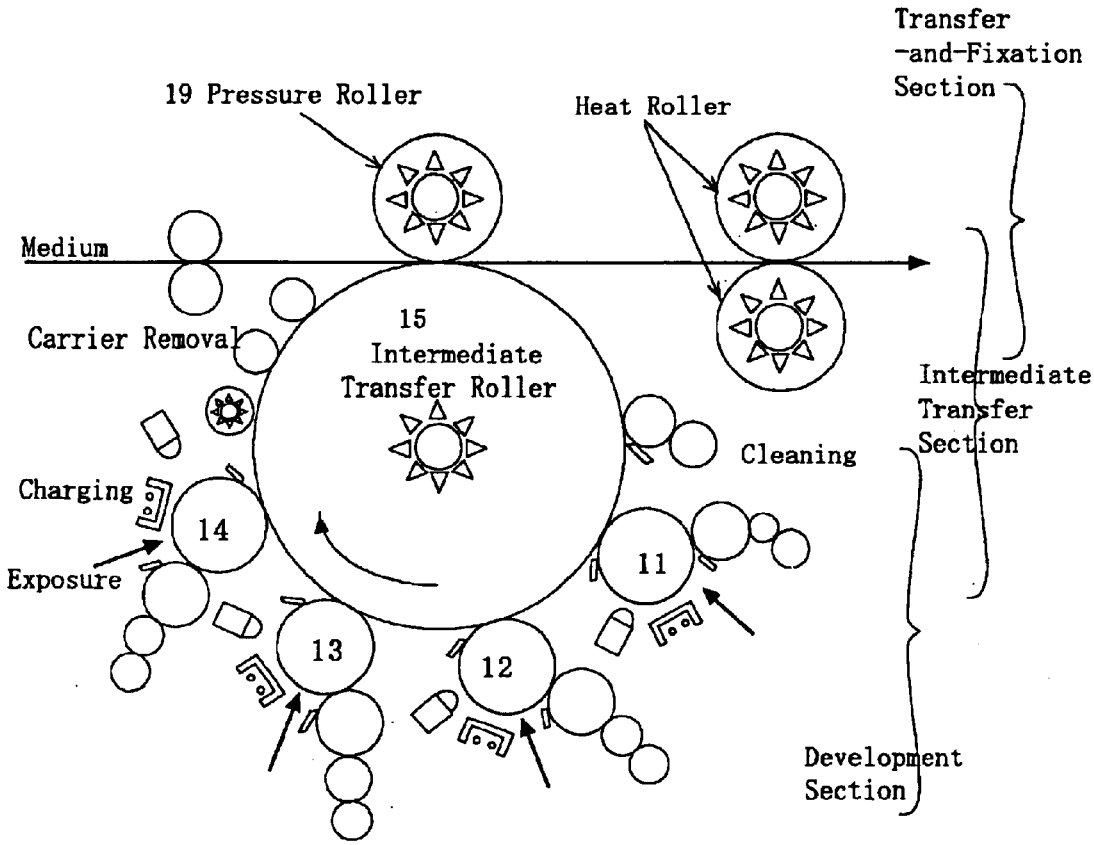
FIG. 3 is a view showing a third configuration example of a liquid-development-type electrophotographic apparatus that embodies the present invention.

FIG. 3 is a view showing a third configuration example of a liquid-development-type electrophotographic apparatus that embodies the present invention. The third configuration example differs greatly from the second configuration example, which has been described with reference to FIG. 2, in that in place of the intermediate transfer belt, an intermediate transfer roller 15, which serves as an intermediate transfer body, is used.

The illustrated liquid-development electrophotographic apparatus includes a development section provided at a bottom portion of the apparatus, an intermediate transfer section disposed above the development section, and a transfer-and-fixation section located at a top portion of the apparatus. The development section is configured basically in a manner similar to those of FIGS. 1 and 2 and includes development subsections corresponding to yellow, magenta, cyan, and black. The development section includes photosensitive drums (photosensitive bodies) 11-14, chargers for electrostatically charging the photosensitive drums 11-14, exposure units, and destaticizers.

The intermediate transfer roller 15 serves as an intermediate transfer body. The intermediate transfer roller 15 is biased at about −800 V, whereby toner is transferred onto the intermediate transfer roller 15 from the photosensitive drums 11-14 according to electric fields established between the intermediate transfer roller 15 and the photosensitive drums 11-14. Transfer of toner onto the intermediate transfer roller 15 Is performed, for example, in the following manner: first, transfer of a yellow toner adhering to the first photosensitive drum 11; subsequently, at a magenta transfer section for transferring a second toner; i.e., a magenta toner, transfer of the magenta toner adhering to the second photosensitive drum 12; then, transfer of a cyan toner adhering to the third photosensitive drum 13; and finally, transfer of a black toner adhering to the fourth photosensitive drum 14. Toner images in four colors developed on the first to fourth photosensitive drums 11-14 are sequentially superposed on the intermediate transfer roller 15 through a single rotation of the intermediate transfer roller 15, to thereby form a color image.

Subsequently, carrier liquid is removed from the 4-color image at the carrier-removing section. Then, the toner image is melted through application of heat at a contact portion between the intermediate transfer roller 15 and a printing medium by means of a heater disposed within the intermediate transfer roller 15 and turned on at an appropriate time and a heater-incorporated pressure roller 19, followed by melt transfer of the resulting molten toner image onto the printing medium. In the illustrated apparatus, two heat rollers are disposed downstream of the melt transfer position so as to apply pressure to the printing medium for fixing the toner image on the same. Since a fixation section, which generates a large amount of heat, is separated from a transfer section, the amount of heat generated at the transfer section can be suppressed to a low level.

An image which is formed on the intermediate transfer roller 15 by means of a liquid toner contains carrier liquid. The carrier oil component is removed from the toner image at the carrier-removing section, which is composed of three rollers in the illustration. Among the illustrated three rollers, the first roller assumes the form of a heat roller so as to apply heat during removal of carrier. In order to remove residual toner from the intermediate transfer roller 15, a cleaning roller and a cleaning blade, which contact the intermediate transfer roller 15 at an appropriate time, are provided. The toner image on the intermediate transfer roller 15 is melted through application of heat by means of a heater-incorporated pressure roller 19. The resulting molten toner image is fixed by use of the two heat rollers.

As in the case of the apparatus shown in FIGS. 1 and 2, the liquid-development electrophotographic apparatus shown in FIG. 3 is configured such that the transfer-and-fixation section, which generates a large amount of heat, is disposed at a top portion of the apparatus. Thus, heat can be efficiently released from inside the apparatus, thereby enhancing the efficiency of cooling the intermediate transfer roller 15. Also, as in the case of FIGS. 1 and 2, the development section, which handles a liquid toner, is disposed at a bottom portion of the apparatus. Thus, even when the liquid toner spills, a printing medium is hardly smudged.

Figure 4:
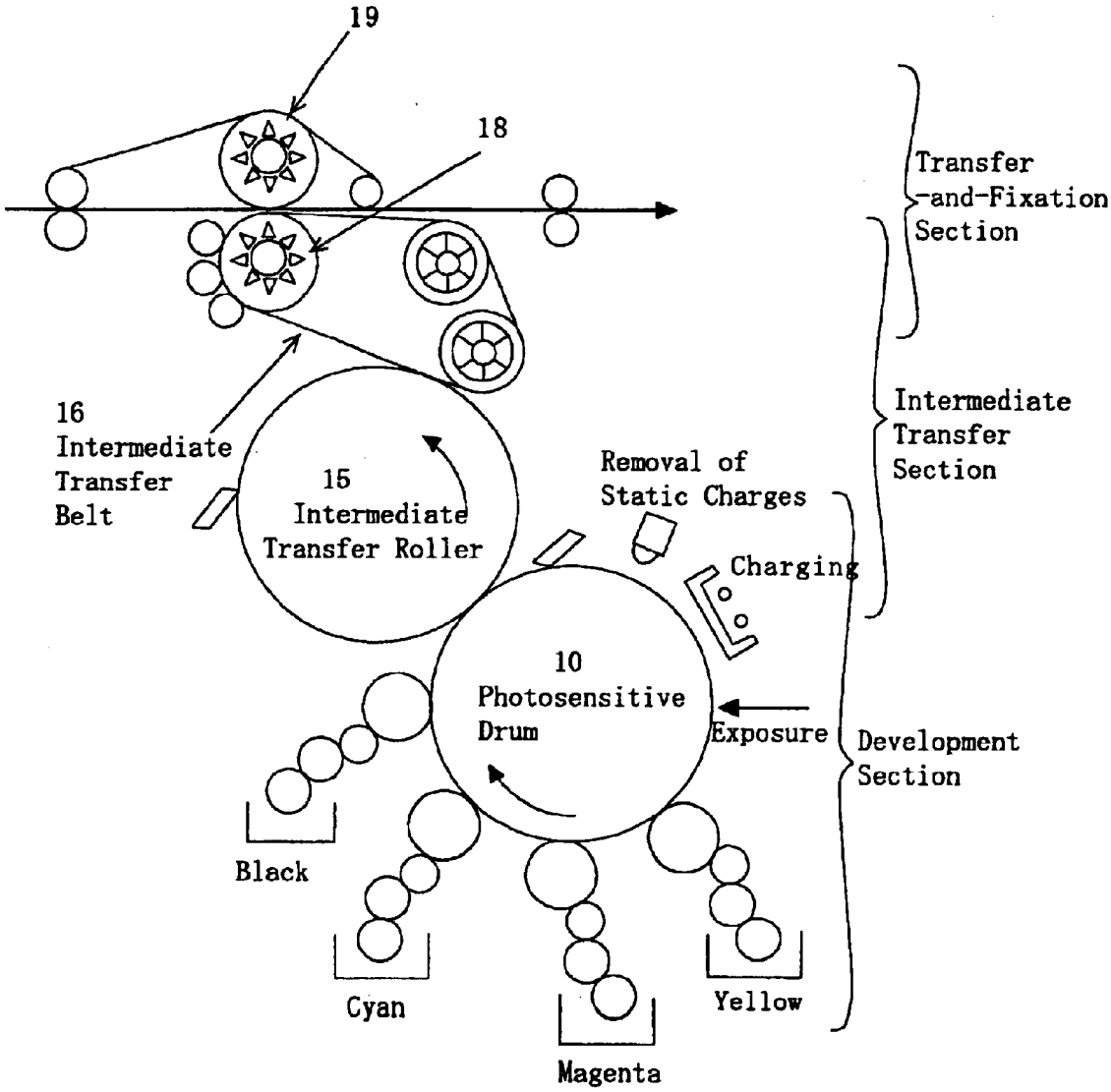
FIG. 4 is a view showing a fourth configuration example of a liquid-development-type electrophotographic apparatus that embodies the present invention.

FIG. 4 is a view showing a fourth configuration example of a liquid-development-type electrophotographic apparatus that embodies the present invention. This configuration is characterized in that a single photosensitive drum 10 is used in common among four color toner images; an intermediate transfer roller 15 is used as a first intermediate transfer body; and an intermediate transfer belt 16 is used as a second intermediate transfer body.

The illustrated liquid-development electrophotographic apparatus includes a development section provided at a bottom portion of the apparatus, an intermediate transfer section disposed above the development section, and a transfer-and-fixation section located at a top portion of the apparatus. The development section includes development subsections corresponding to yellow, magenta, cyan, and black as in the previously described configurations; however, the photosensitive drum (photosensitive body) 10 is provided for common use among four colors. Accordingly, a charger for electrostatically charging the photosensitive drum 10, an exposure unit, and a destaticizer are used in common among four colors. Their operations are similar to those in the previously described examples, and thus detailed description thereof is omitted.

The intermediate transfer roller 15 is biased at about −800 V, whereby yellow, magenta, cyan, and black toners adhering to the photosensitive drum 10 are sequentially transferred onto the intermediate transfer roller 15 according to an electric field established between the intermediate transfer roller 15 and the photosensitive drum 10, and thus toner images in four colors are superposed on the intermediate transfer roller 15. The resulting 4-color toner image formed on the intermediate transfer roller 15 is transferred onto the intermediate transfer belt 16, which serves as the second intermediate transfer body. The subsequent transfer-and-fixation operation is similar to that of the apparatus of FIG. 1, and thus its detailed description is omitted.

As in the case of the apparatus shown in FIGS. 1 to 3, the liquid-development electrophotographic apparatus shown in FIG. 4 is configured such that the transfer-and-fixation section, which generates a large amount of heat, is disposed at a top portion of the apparatus. Thus, heat can be efficiently released from inside the apparatus, thereby enhancing the efficiency of cooling the intermediate transfer roller 15. Also, as in the case of FIGS. 1 to 3, the development section, which handles a liquid toner, is disposed at a bottom portion of the apparatus. Thus, even when the liquid toner spills, a printing medium is hardly smudged.

As described above, according to the present invention, since the development section is disposed at a lower portion of the apparatus, accidental spilling of a liquid toner is unlikely to smudge the printing medium, the intermediate transfer roller, the intermediate transfer belt, and their relevant devices, and such a spill can be readily coped with.

According to the present invention, the transfer-and-fixation section is disposed at an upper portion of the apparatus, thereby facilitating release of heat from the apparatus and prevention of thermal propagation into the interior of the apparatus.

Figure 5:
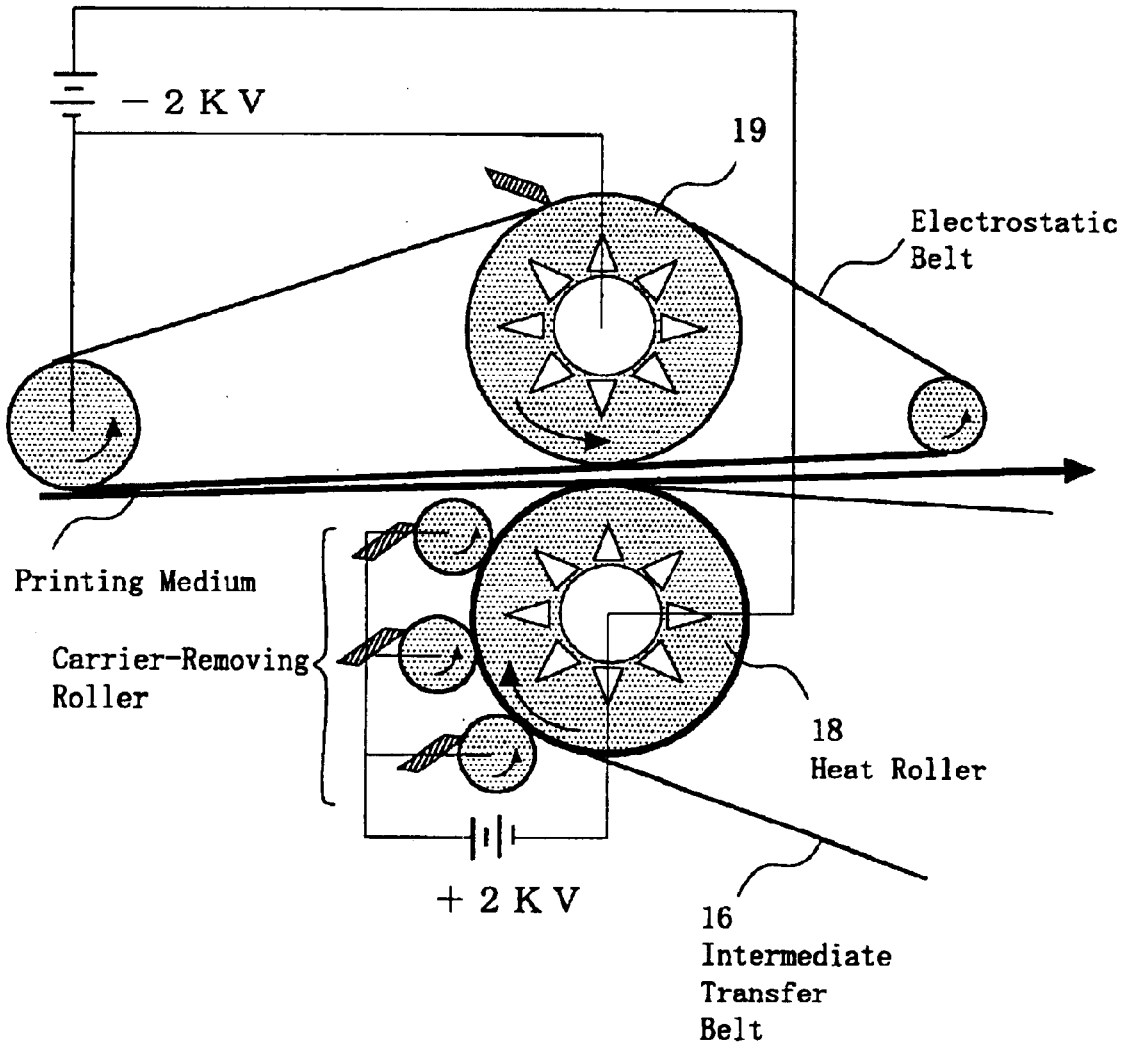
FIG. 5 is a detail view showing a transfer-and-fixation section and a carrier-removing section of the electrophotographic apparatus shown in FIG. 1.

FIG. 5 is a detail view showing the transfer-and-fixation section of the electrophotographic apparatus shown in FIG. 1. As illustrated, three carrier-removing rollers are provided on a portion of the intermediate transfer belt 16 which abuts the heat roller 18. The configuration and operation of the carrier-removing rollers will be described later in detail.

A tone image on the intermediate transfer belt 16 is melted through application of heat from the heat roller 18. The resulting molten toner image is transferred onto and fixed on a printing medium by means of the heater-incorporated pressure roller 19, which operates in cooperation with the heat roller 18.

The transfer-and-fixation section includes the pressure roller 19, a plurality of conveyance rollers, an electrostatic belt looped around and mounted on the conveyance rollers, and the intermediate transfer belt 16. The electrostatic belt electrostatically chucks a printing medium to thereby convey the printing medium. Heating by means of the heat roller 18 improves the efficiency of carrier removal, and, in cooperation with the heater-incorporated pressure roller 19, melts a toner image on the intermediate transfer belt 16 to thereby transfer the resulting molten toner image onto and fix on the printing medium. After transfer and fixation, the thus heated intermediate transfer belt 16 is cooled.

Dimethyl silicone rubber, which exhibits high toner releasability, is used as a surface material, serving as an image formation surface, of the intermediate transfer belt 16. The electric resistance of dimethyl silicone rubber is set to a semiconductive range of 1E4-1E12 ($10^4$-$10^{12}$) Ω as measured after swelling with carrier oil. As a result, at the time of removal of excessive oil, a high intensity of electric field induced by setting to the semiconductive range prevents deterioration in toner image. At the time of transfer onto paper, the high releasability of dimethyl silicone rubber and a high intensity of electric field induced by setting to the semiconductive range realize high transfer efficiency.

After excessive oil is removed by means of a carrier-removing roller, for example, an electric field oriented in the transfer direction (a reverse bias) of such an intensity as not to effect transfer is applied to a downstream roller before transfer onto a printing medium is performed. Such application of electric field weakens the force of retaining toner on the image formation surface of the intermediate transfer belt 16, thereby achieving high efficiency in transfer onto paper. Furthermore, as a result of weakening of the force of retaining toner on the image formation surface, the surface of paper containing a transferred image becomes smooth; i.e., printing at high picture quality can be performed.

In printing on a sheet requiring transparency, such as an OHP sheet, melt transfer is performed without prior removal of excessive oil, whereby the excessive oil significantly improves fluidity of toner. Thus, without involvement of increasing fixation temperature or decreasing fixation speed, toner integration is accelerated, whereby transparency can be increased. After transfer, excessive oil is removed from the sheet (through wiping or by use of a removing roller), thereby eliminating oily appearance.

A material whose resistance varies within a semiconductive range (1E4 Ω to 1E12 Ω) with temperature (80° C.–180° C.) (e.g., ionic conductive rubber or a carbon-containing rubber) is used as a surface rubber material for the pressure roller 19, to which a bias is applied. Also, the heating temperature of the pressure roller 19 is controlled according to a printing medium. As a result, even though an applied bias is constant, an electric field of an optimum intensity for each of various media can be applied merely by use of a heating-temperature regulator, which is inexpensive. For example, the intensity of an electric field is increased with the thickness of paper. Also, the intensity of an electric field is desirably increased for film of polyester or the like. In order to suppress variations in fixation strength among media, a material that exhibits a great change in resistance with temperature is particularly preferred. A heater for changing temperature can also be used as a heater for transfer and fixation, thereby avoiding increase in cost.

Figure 6:
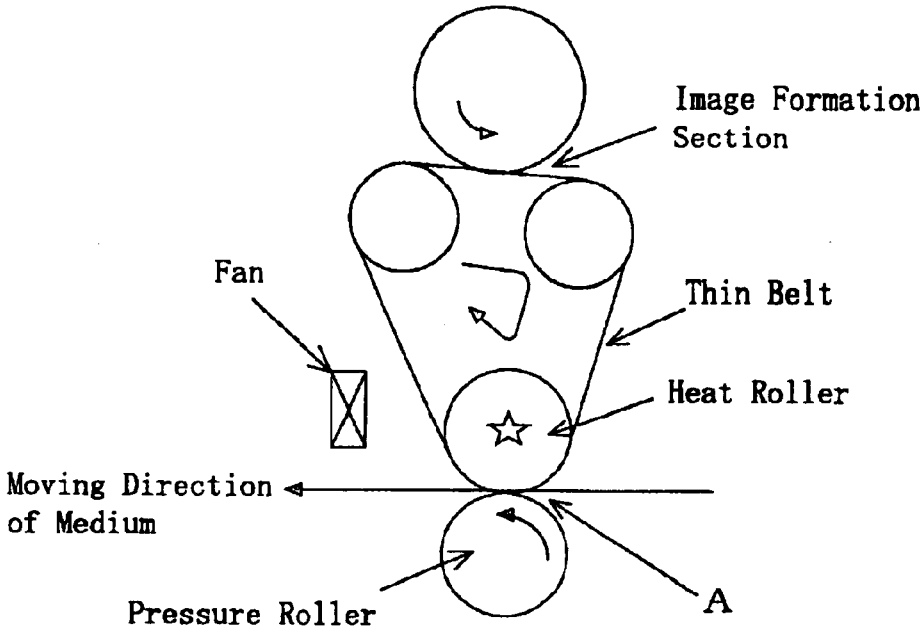
Fig. 6 Prior Art
FIG. 6 is a view showing prior art technology which uses a fan or the like for cooling an intermediate transfer belt.
Figure 7:
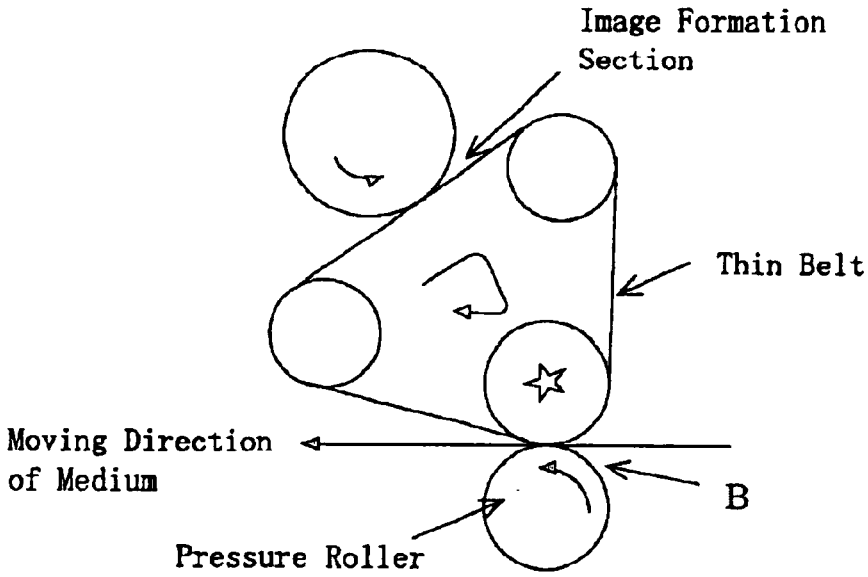
FIG. 7 is a view for explaining the relationship between a heat roller and an intermediate transfer belt looped around and mounted on the heat roller.
Figure 8:
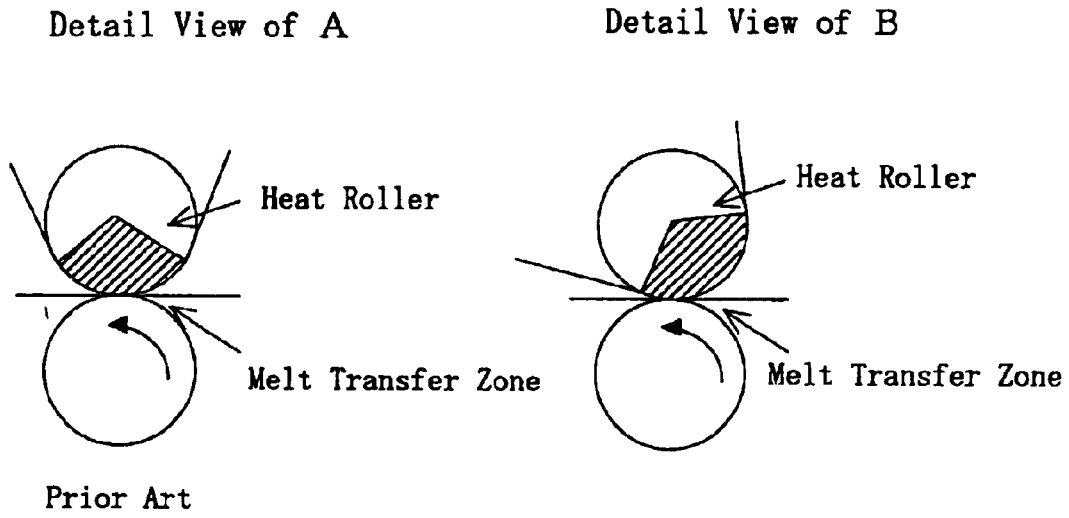
FIG. 8 shows detail views of portions A and B of FIGS. 6 and 7, respectively.

FIG. 7 is a view for explaining the relationship between a heat roller and an intermediate transfer belt looped around and mounted on the heat roller. As illustrated, a portion of the intermediate transfer belt looped around and mounted on the heat roller as measured after melt transfer is set smaller than that for recovering a temperature drop of the intermediate transfer belt caused by melt transfer. Specifically, the pressure roller is in contact with the intermediate transfer body assuming the form of a belt at a point where the intermediate transfer body leaves the heat roller, or in the vicinity of the point. In this case, the angle between the direction of conveyance of a medium and the intermediate transfer belt is desirably 5 degrees or less. A detail view of portion B of FIG. 8 is shown at the right of FIG. 8. In FIG. 8, a hatched portion of the heat roller indicates a portion of the belt which is in contact with the heat roller. The portion of the belt in contact with the heat roller is heated. For contrast, a detail view of portion A of prior art technique shown in FIG. 6 is shown at the left of FIG. 8. In the detail view of portion A, even after leaving a melt transfer zone, the belt is still in contact with the heat roller. By contrast, in the detail view of portion B, immediately after leaving the melt transfer zone, the belt leaves the heat roller. Accordingly, the amount of heat to be accumulated after melt transfer is reduced, thereby facilitating cooling and thus suppressing energy required for cooling to a low level.

As described above, the present invention uses a material having low surface energy (e.g., dimethyl silicone rubber) as a surface material, serving as an image formation surface, of the intermediate transfer body, and the electric resistance of the surface material is set to a semiconductive range of 1E4-1E12 Ω, thereby preventing deterioration in toner image which would otherwise be caused by a removing roller, and thus avoiding impairment in efficiency of transfer onto a printing medium in the subsequent step.

In printing on a sheet requiring transparency, such as an OHP sheet, melt transfer is performed without prior removal of excessive oil, and after melt transfer is performed, excessive oil is removed from the sheet, whereby without reduction in printing speed, toner can be sufficiently melted to thereby be increased in fluidity, and thus integration of a molten toner can be accelerated.

The present invention uses a material whose resistance varies within a semiconductive range with temperature, as a surface material for the pressure roller. Also, the temperature of the pressure roller is controlled according to a printing medium. Thus, the present invention does not need to use a variable bias power supply, which is expensive and adapted to apply a bias in a variable condition; i.e., an electric field of an optimum intensity can be applied according to a printing medium to be used.

According to the present invention, the pressure roller is in contact with the intermediate transfer body assuming the form of a belt at a point where the intermediate transfer body leaves the heat roller, or in the vicinity of the point. Thus, cooling does not require a large amount of energy, and the influence of heat on a photosensitive body can be reduced.

Referring back to FIG. 5, the carrier-removing section of the electrophotographic apparatus of FIG. 1 will be described in detail. As illustrated, three carrier-removing rollers are provided on a portion of the intermediate belt 16 which abuts the heat roller 18. These carrier-removing rollers contact a toner layer on the intermediate transfer belt, which is heated to not lower than a melting temperature of toner or a temperature near the melting temperature, thereby removing excessive oil from the toner layer. A bias voltage is applied to the carrier-removing rollers. The bias; for example, a voltage of +2 KV with respect to the heat roller, is applied to the carrier-removing rollers in such a direction as to press toner particles against the intermediate transfer belt which retains an image. For transfer and fixation, a bias voltage of −2 KV with respect to the heat roller is applied to the pressure roller 19. The carrier-removing rollers are electrically conductive rollers having an electric resistance similar to or lower than that of a molten toner. The surface of each of the carrier-removing rollers is in a specular state; i.e., smoothed. The carrier-removing rollers has heat resistance to be resistant to a heating temperature and electric resistance to be resistant to an applied bias voltage. Each of the carrier-removing rollers is equipped with a blade or the like for collecting carrier. Notably, in place of the illustrated carrier-removing rollers, carrier-removing belts may be used.

A force which each of the plurality of carrier-removing rollers imposes on the intermediate transfer belt can be set individually, for example, such that as removal of carrier proceeds along the moving direction of the intermediate transfer belt 16, the force is gradually increased. A force which each of the carrier-removing rollers imposes on the intermediate transfer belt 16 can be adjusted on the basis of the results of analysis of a print pattern.

A bias voltage with respect to the heat roller 18; i.e., with respect to the intermediate transfer belt, to be applied to each of the plurality of carrier-removing rollers can be set individually, for example, such that as the electrical conductivity of toner increases with removal of carrier, the bias voltage is decreased. Also, a bias voltage to be applied to each of the carrier-removing rollers can be adjusted on the basis of the results of analysis of a print pattern.

Hardness of each of the plurality of carrier-removing rollers can be set individually, for example, such that as removal of carrier proceeds, the hardness increases.

Surface roughness of each of the plurality of carrier-removing rollers can be set individually, for example, such that as removal of carrier proceeds, specularity is enhanced. Preferably, the carrier-removing rollers are rotated in such a direction that polish grains of the rollers associated with specular finish do not disturb an image.

The apparatus of the present invention can further include means for heating the carrier-removing rollers, such as heaters incorporated in the corresponding carrier-removing rollers, and means for detecting temperature of the carrier-removing rollers, so as to control the temperature of the carrier-removing rollers at a constant level, thereby maintaining the carrier-removing rollers at a constant electric resistance for stable carrier removal.

A toner image on the Intermediate transfer belt 16 is melted through application of heat from the heat roller 18. The resulting molten toner image Is transferred onto and fixed on a printing medium by means of the heater-incorporated pressure roller 19, which operates in cooperation with the heat roller 18.

Time required to superpose toner images in a plurality of colors on the intermediate transfer roller 15 can be utilized for controlling; for example, increasing, the speed of the intermediate transfer belt 16 at the time of melt transfer within such a range as not to affect throughput. The speed of the intermediate transfer belt 16 can be controlled such that the intermediate transfer belt 16 rotates a plurality of rotations during a period of time between transfer of the toner images from the intermediate transfer roller 15 onto the intermediate transfer belt 16 and melt transfer of the molten toner images onto a printing medium. This enables the same carrier-removing roller to perform carrier removal a plurality of times without impairment in throughput.

The apparatus of the present invention can further include means for monitoring the number of rotations of the intermediate transfer belt 16 and changing a bias voltage to be applied to the carrier-removing rollers, according to the number of rotations. As removal of carrier proceeds with rotations of the intermediate transfer belt 16, an optimum bias voltage to be applied varies. Thus, an optimum bias voltage is set according to the number of rotations.

The apparatus of the present invention can further include means for monitoring the number of rotations of the intermediate transfer belt 16 and changing a force which the carrier-removing rollers impose on the intermediate transfer belt 16, according to the number of rotations. As removal of carrier proceeds with rotations of the intermediate transfer belt 16, an optimum force to be imposed varies. Thus, an optimum force to be imposed is set according to the number of rotations.

The condition of a toner image on the intermediate transfer belt 16 is detected. When the detected condition indicates that a large amount of carrier liquid remains in the toner image, the intermediate transfer belt 16 is rotated more than a regular operation sequence. That is, through idle rotation of the intermediate transfer belt 16, the number of times of passage along the carrier-removing rollers can be increased. Thus, the surface potential of the intermediate transfer belt 16 retaining a heated toner layer is detected; the amount of residual carrier on the intermediate transfer belt 16 is determined from a table describing the relation of the surface potential to the amount of residual carrier; and when the amount of residual carrier is large, the operation sequence can be modified such that the intermediate transfer belt 16 is rotated two rotations. Alternatively, the amount of residual carrier can be determined in the following manner: a reflection-type optical sensor for detecting gloss whose incident angle of light and reflection angle of light are the same is provided on the intermediate transfer belt 16 retaining the heated toner layer; and the amount of residual carrier is determined from a reflection output from the optical sensor.

The apparatus of the present invention can be configured in the following manner: a plurality of carrier-removing rollers are provided in such a manner as to abut the intermediate transfer belt and such that the carrier-removing rollers can abut and retreat from the intermediate transfer belt independently of one another; and the number of carrier-removing rollers abutting the intermediate transfer belt is controlled according to the amount of residual carrier and in consideration of the number of rotations of the intermediate transfer belt.

In order to prevent a change in resistance of a carrier-removing roller, which is made of semiconductive rubber or the like, caused by partial temperature rise of the carrier-removing roller, the carrier-removing roller is retreated from the intermediate transfer belt 16 when the carrier-removing roller faces a region other than a print region or when printing is not performed.

In order to maintain electrical characteristics (resistance and the like) of a carrier-removing roller in stably constant conditions, the temperature of the carrier-removing roller must be maintained at a constant level. Thus, the carrier-removing roller is equipped with a heater which serves as a heat source for temperature control. For example, the carrier-removing roller assumes the form of a pipe roller, and a halogen lamp heater is contained within the pipe roller. A temperature sensor is provided on the surface of the pipe roller so as to turn on/off the heater at a certain temperature; for example, at 70–80° C. When the carrier-removing roller is not equipped with a heat source, such as a heater, the carrier-removing roller is caused to rotate through contact with the intermediate transfer belt 16, which is heated, to thereby be heated to a certain temperature through thermal conduction. In this case, preferably, a temperature sensor is provided on the surface of the carrier-removing roller.

In a system in which resistance of a carrier-removing roller is monitored, the resistance is calculated from voltage and current as measured when the voltage is applied between the carrier-removing roller and the intermediate transfer belt 16 while the carrier-removing roller is in contact with the intermediate transfer belt 16, and heating is controlled such that the resistance falls within a predetermined range.

In a system which uses a single or a plurality of carrier-removing rollers, preferably, the temperature of the carrier-removing roller or the temperature of the last carrier-removing roller among the plurality of carrier-removing rollers is set higher than the temperature of the intermediate transfer belt 16. Carrier liquid tends to ooze from a thermally hot side toward a cold side. Thus, when the temperature of the last carrier-removing roller is set higher than that of the intermediate transfer belt 16, residual carrier liquid oozes at the boundary between the intermediate transfer belt 16 and a molten toner layer, thereby serving as a release material and thus preventing defective transfer.

In the case of a full color printer, a transfer bias voltage to be applied to the intermediate transfer belt 16 may differ between monochrome printing and printing in two or more colors to be superposed. Since the potential difference (intensity of electric field) between the intermediate transfer belt 16 and a carrier-removing roller is an important bias for removing carrier from the intermediate transfer belt 16, a bias voltage for removal of carrier is applied according to the number of colors of toner images to be superposed on the intermediate transfer belt 16; for example, 1 KV is applied in monochrome printing, and 1.5 KV is applied in printing in two colors to be superposed.

Application of a bias voltage to a carrier-removing roller causes current to flow from the carrier-removing roller to the intermediate transfer belt 16; as a result, the current may cause variations in the electric potential of the intermediate transfer belt 16. Thus, the bias voltage applied to a carrier-removing roller is controlled such that an unnecessarily large current; for example, a current of not less than 1 mA does not flow.

Figure 9:
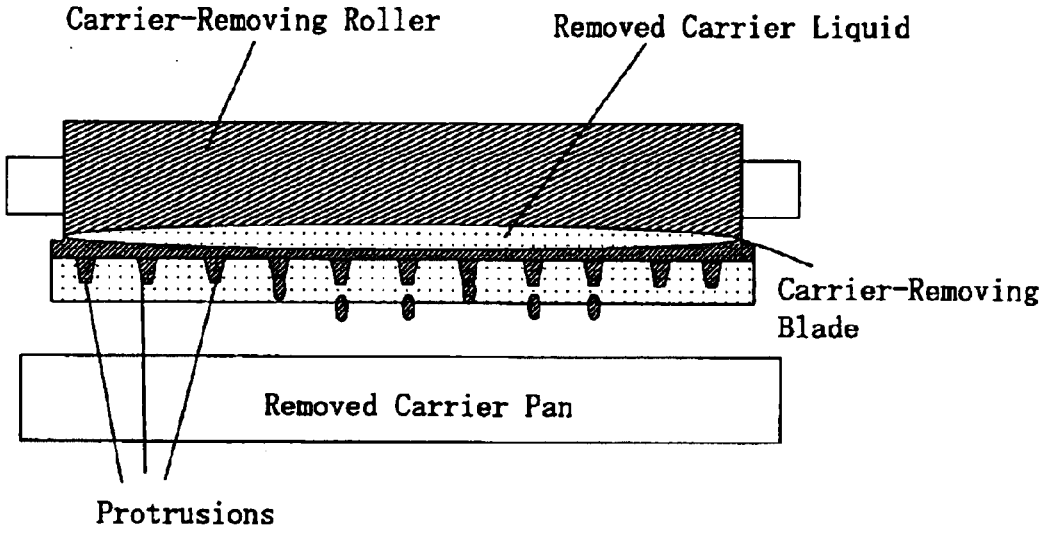
FIG. 9 is a view showing the configuration of a blade for scraping off carrier liquid from a carrier-removing roller.

A blade for scraping off carrier liquid from a carrier-removing roller can have a plurality of protrusions projecting gravitationally downward. FIG. 9 shows the carrier-removing roller, a tip of the blade which contacts the carrier-removing roller from underneath, and carrier liquid collected at the tip of the blade. The protrusions cause the carrier liquid collected at the blade tip to drip promptly.

Conventionally, there has been a limit to removal of a carrier solvent that fills gaps present among toner particles. By contrast, according to the present invention, a carrier-removing roller comes into contact with a toner layer heated to not lower than a melting temperature thereof or a temperature near the melting temperature, and a bias voltage is applied to the carrier-removing roller in such a direction as to press toner particles against an intermediate transfer body which retains an image, whereby excessive carrier can be remove sufficiently and reliably without involvement of disturbance of a toner image.

The present invention can perform optimum carrier removal according to the amount of residual carrier.

Figure 10:
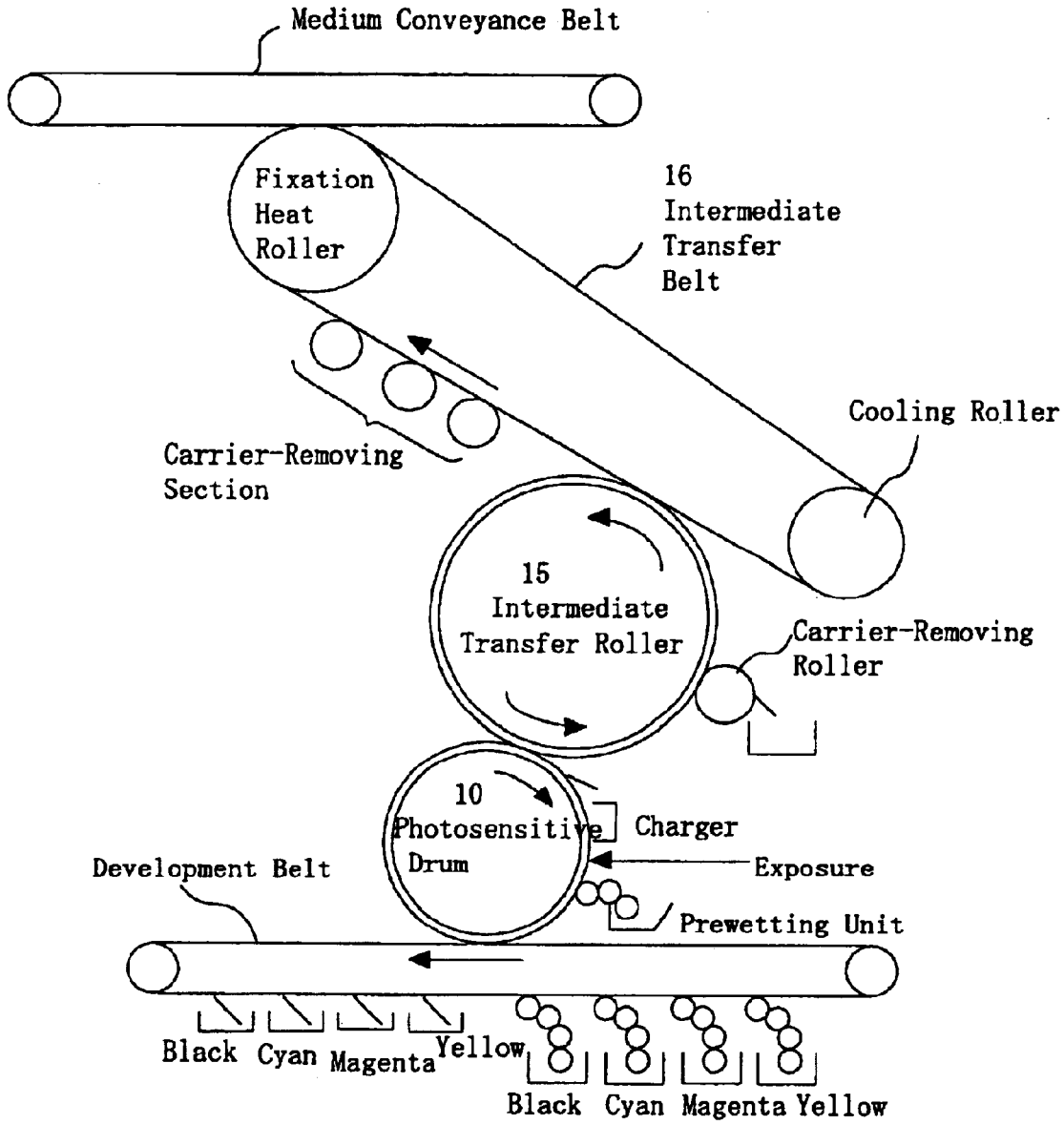
FIG. 10 is a view showing a fifth configuration example of a liquid-development-type electrophotographic apparatus that embodies the present invention.

FIG. 10 is a view showing a fifth configuration example of a liquid-development-type electrophotographic apparatus that embodies the present invention. The illustrated liquid-development electrophotographic apparatus includes a development section provided at a bottom portion of the apparatus, an intermediate transfer section disposed above the development section, and a transfer-and-fixation section located at a top portion of the apparatus. A single photosensitive drum (a photosensitive body) 10 is provided. As in the case of the examples shown in FIGS. 1 to 4, the photosensitive drum 10 is equipped with a charger, a destaticizer, and an exposure unit. A prewetting unit is provided at a position located somewhere downstream of an exposure position and upstream of a development position.

The development section includes a single developing belt for common use among colors, toner supply rollers for supplying and applying liquid toners in yellow, magenta, cyan, and black to the developing belt, and blades for scraping off corresponding color toners which remain on the developing belt after development is completed. The toner supply rollers and the toner scraper blades are horizontally arranged under the developing belt. A plurality of toner supply rollers are provided for each of the color toners. The toner supply rollers draw a highly viscous liquid toner from a toner fountain (a toner tank) and convey the liquid toner to the developing belt while spreading the liquid toner thinner, to thereby apply the liquid toner onto the developing belt at a predetermined layer thickness.

The developing belt is biased at a predetermined voltage of about 400 V-600 V and functions to supply positively charged toner to the photosensitive drum 10 according to an electric field established between the same and the photosensitive drum 10. Toner adheres to exposed portions, which are charged at about 100 V, on the photosensitive drum 10, thereby developing an electrostatic latent image on the photosensitive drum 10 into an image.

Subsequently, an intermediate transfer roller 15 is rotated four rotations, whereby toner images in four colors are sequentially superposed on the intermediate transfer roller 15, to thereby form a color image. The intermediate transfer roller 15 is equipped with a carrier-removing roller. After four color toners are all superposed on the intermediate transfer roller 15, the carrier-removing roller comes into contact with the intermediate transfer roller to thereby remove excessive carrier and prewetting liquid. Subsequently, the 4-color image is electrostatically transferred onto an intermediate transfer belt 16, which serves as the second intermediate transfer body in the form of a belt. After carrier liquid is removed at a carrier-removing section, the toner image on the intermediate transfer belt 16 is melted through application of heat from a fixation heat roller to thereby be melt-transferred onto a printing medium conveyed on a medium conveyance belt at a contact portion between the intermediate transfer belt 16 and the printing medium.

After the toner images in four colors superposed on the intermediate transfer roller 15 are transferred at one time onto the intermediate transfer belt, in the course of formation of a next print image on the intermediate transfer roller 15, the rotational speed of the intermediate transfer belt can be decreased. Also, through decrease In the rotational speed, the temperature of a fixation heater can be set low.

In place of superposition of toner images in four colors on the intermediate transfer roller 15, the toner images in four colors are sequentially transferred from the photosensitive drum 10 to the intermediate transfer roller 15 and then to the intermediate transfer belt 16 on a basis of a single color to thereby superpose the toner images in four colors on the intermediate transfer belt 16. In this case, the circumferential length of the photosensitive drum 10 and that of the intermediate transfer roller 15 can be shorter than the longitudinal length of an image region to thereby reduce a size of the apparatus. For example, each of the circumferential lengths can be half of the longitudinal length of the image region, whereby a single image is completed through two rotations of the photosensitive drum 10 and the intermediate transfer roller 15. This configuration reduces the size of the apparatus.

The intermediate transfer belt 16 can be configured such that a polyimide substrate is coated with silicone rubber or fluorosilicone rubber at a thickness of 5–50 $\mu$m so as to form an elastic layer on the belt surface. The elastic layer ensures pressing of a toner image against a printing medium at a nip section, thereby enabling melt transfer onto a printing medium having relatively rough surface, such as wood free paper. An image which is formed on the intermediate transfer belt 16 by means of a liquid toner contains carrier liquid. The carrier oil component is removed from the toner image at a carrier-removing section, which is composed of a plurality of rollers in the illustration. The carrier-removing section is provided at an appropriate position located somewhere between a position where the intermediate transfer belt 16 contacts the intermediate transfer roller 15 and a position where a toner image on the intermediate transfer belt is melted through application of heat.

Removal of carrier can be performed during a period of time after the toner images in four colors are transferred onto the intermediate transfer belt 16 and before a next print image is formed on the intermediate transfer roller. A carrier-removing unit can be configured in the following manner. The carrier-removing unit may be configured such that the carrier-removing unit is retreated while the toner images are transferred onto the intermediate transfer belt 16 and while the transferred toner images pass a fixation heat roller. Only when the toner images are melted through application of heat from the fixation heat roller and then cooled to be solidified, the carrier-removing unit comes into contact with the intermediate transfer belt 16 to thereby remove carrier.

A printing medium is conveyed on, for example, an electrostatic chuck belt which electrostatically chucks the printing medium to thereby convey the printing medium. At a transfer-and-fixation section, a toner image on the intermediate transfer belt 16 is melted, and the resulting molten toner image is transferred onto and fixed on the printing medium. The electrostatic chuck belt can be equipped with a retreat mechanism for bringing the electrostatic chuck belt in contact with the intermediate transfer belt 16 only when transfer onto the printing medium is performed at the transfer-and-fixation section.

Heating by means of the fixation heat roller is intended to melt a toner image on the intermediate transfer belt 16 to thereby transfer the resulting molten toner image onto and fix on the printing medium. After transfer and fixation, the thus heated intermediate transfer belt 16 must be cooled. Cooling is performed at a position located somewhere downstream of a position where the intermediate transfer belt 16 comes into contact with the printing medium and upstream of a position where the intermediate transfer belt 16 comes into contact with the intermediate transfer roller. Cooling can be performed by means of, for example, a cooling roller which the intermediate transfer belt 16 is looped around and mounted on. The cooling roller can be internally equipped with fins, against which air is blown for cooling. Cooling is performed in order to prevent a thermal deterioration of the photosensitive drum, which would otherwise result from transmission of heat to the photosensitive drum.

The intermediate transfer belt can assume a thickness of 5–50 $\mu$m so as to reduce thermal capacity, whereby after being heated at a contact portion between the same and a printing medium, the intermediate transfer belt is cooled naturally.

In addition to means for cooling the intermediate transfer belt, means for cooling the intermediate transfer roller can be provided. The intermediate transfer roller can be cooled, for example, in the following manner: fins are provided within the intermediate transfer roller, and air is blown against the fins by use of a fan.

As described above, the illustrated liquid-development electrophotographic apparatus is configured such that the transfer-and-fixation section, which generates a large amount of heat, is disposed at a top portion of the apparatus. Thus, heat can be efficiently released from inside the apparatus, thereby enhancing the efficiency of cooling the intermediate transfer belt 16. Also, since the development section, which handles a liquid toner, is disposed at a bottom portion of the apparatus, even when the liquid toner spills, a printing medium is hardly smudged.

The illustrated configuration is such that the intermediate transfer belt 16 and the intermediate transfer roller 15 are separated from each other at times other than during transfer of a toner image. The separating operation can be performed by means of the mechanism for retreating the intermediate transfer belt 16. Through employment of the configuration, heat transmission from the intermediate transfer belt 16 to the intermediate transfer roller 15 and then to the photosensitive drum 10 can be shut off. Also, through reduction of the rotational speed of the intermediate transfer belt 16 to a one-fourth speed after transfer of a toner image onto the intermediate transfer belt 16, a heating temperature for the intermediate transfer belt 16 can be decreased.

As described above, the present invention employs a mechanism for separating a primary intermediate transfer body and a secondary intermediate transfer body from each other at times other than during transfer of a toner image from the primary intermediate transfer body to the secondary intermediate transfer body, thereby preventing a thermal deterioration of a photosensitive drum, which would otherwise result from transmission of heat from the heated secondary intermediate transfer body to the photosensitive drum via the primary intermediate transfer body. The mechanism enables efficient heating and cooling without involvement of a drop in real throughput.

The fifth configuration example of the electrophotographic apparatus shown in FIG. 10 employs the primary intermediate transfer body assuming the form of a roller and the secondary intermediate transfer body assuming the form of a belt. The configuration of transfer from the roller to the belt provides a wide nip width to thereby lengthen a transfer time. Lengthening of the transfer time enhances the efficiency of transfer.

By contrast, the intermediate transfer section may employ a roller in place of the intermediate transfer belt 16 shown in FIG. 10; i.e., the intermediate transfer section may include two rollers serving as a primary intermediate transfer body and a secondary intermediate transfer body. The configuration of roller-to-roller transfer can provide stable contact and can easily increase a nip pressure which is produced by the two rollers.

Preferably, a material for the secondary intermediate transfer body assumes a two-layer structure composed of a surface layer and an underlying layer, and the resistance of the surface layer is higher than that of the underlying layer. This configuration can suppress current which flows toward the surface of the secondary intermediate transfer body. As a result, during electrostatic secondary transfer, scattering of toner toward the surface is prevented, thereby imparting sharp edges to an image.

A material for the primary intermediate transfer body can employ an elastic rubber material as an underlying layer. Through employment of the elastic rubber material, contact between the primary intermediate transfer body and the secondary intermediate transfer body is enhanced, thereby preventing uneven contact between them and thus enabling uniform transfer.

Figure 11:
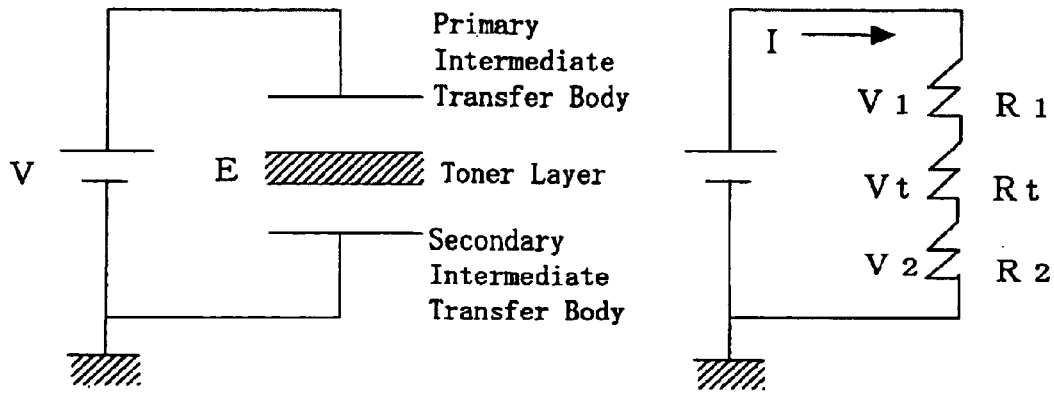
FIG. 11 is a view showing a sixth configuration example of a liquid-development-type electrophotographic apparatus that embodies the present invention.

Preferably, the materials for the primary and secondary intermediate transfer bodies are lower in resistance than toner. This will be explained with reference to FIG. 11. At the time of electrostatic secondary transfer, a bias voltage V is applied between the primary intermediate transfer body and the secondary intermediate transfer body while a toner layer is interposed therebetween. This is modeled at the left of FIG. 11, and its equivalent circuit is shown at the right of FIG. 11. Through decreasing of a resistance R1 of the primary intermediate transfer body and a resistance R2 of the secondary intermediate transfer body, a voltage E to be applied to a toner layer is increased to thereby increase the intensity of an electric field E to be applied to the toner layer.

Preferably, the materials for the primary and secondary intermediate transfer bodies employ a material having high dielectric constant as an underlying layer. A material having high dielectric constant has a large electrostatic capacity and allows a greater current to flow in an operated state than in a standstill state. A material having low resistance and high dielectric constant allows more current to flow therethrough, and therefore, its apparent resistance decreases in the operated state.

Figure 12:
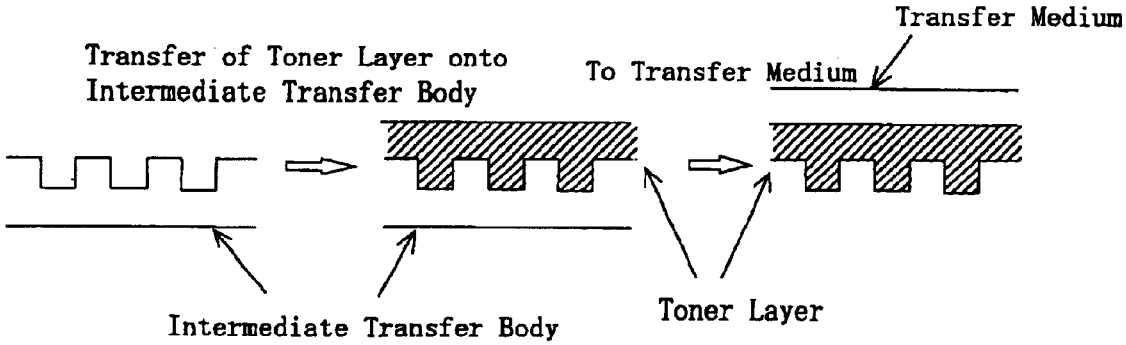
FIG. 12 is a view showing a seventh configuration example of a liquid-development-type electrophotographic apparatus that embodies the present invention.
Figure 13:
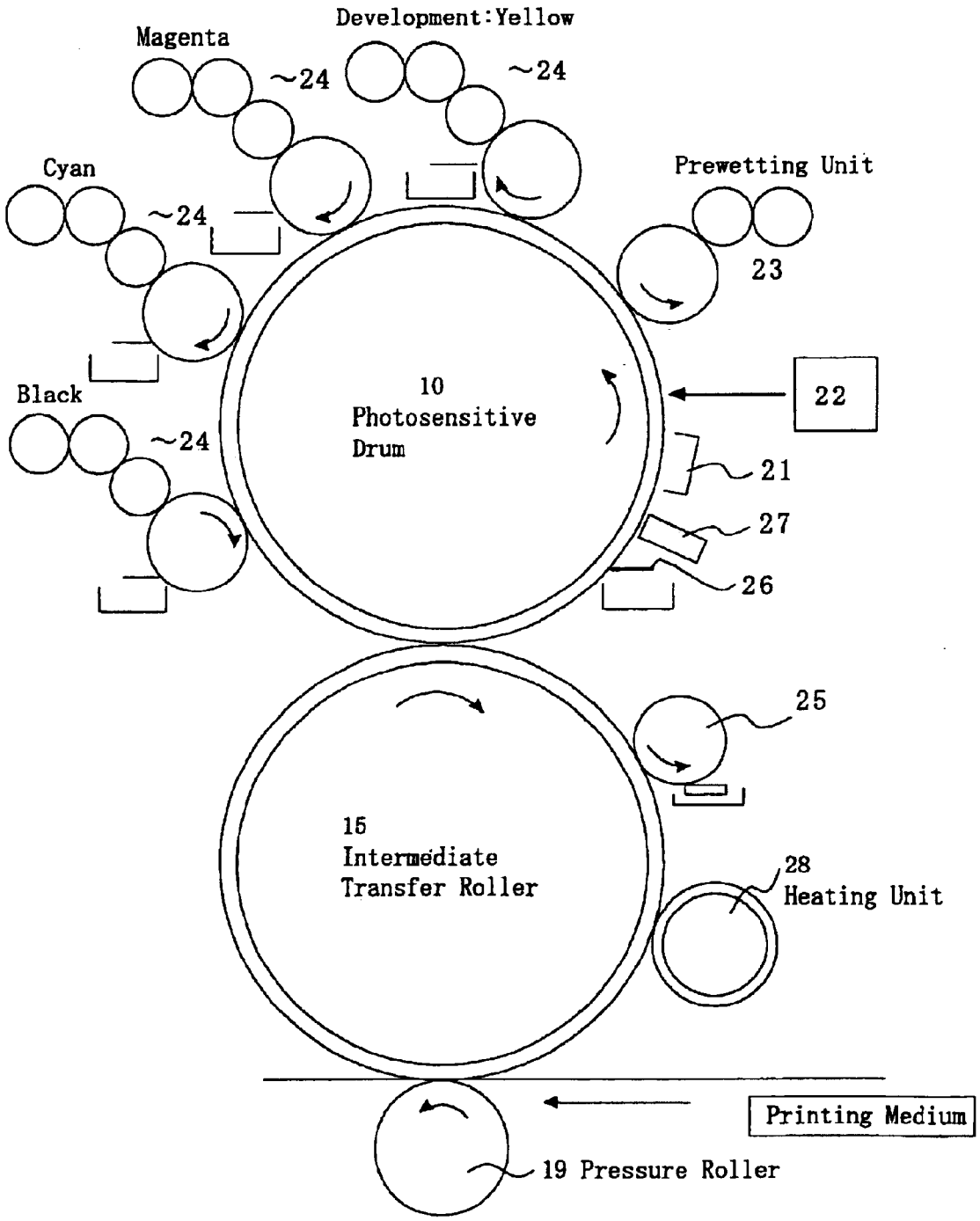
Fig. 13 Prior Art
FIG. 13 is a view showing an overall configuration of a conventional liquid-development-type electrophotographic apparatus.

Preferably, the materials for the primary and secondary intermediate transfer bodies are in a specular state. This will be explained with reference to FIG. 12. A left-hand view of FIG. 12 shows a model of the surface of an intermediate transfer body having projections and pits. A central view of FIG. 12 shows a state in which a toner layer is transferred onto the projections and pits. As shown in a right-hand view of FIG. 12, when the toner layer is transferred on to the subsequent transfer medium, projections and pits appear on the surface of the toner layer. In order to improve the quality of image printing, the surface of an intermediate transfer body is preferably smooth to the greatest possible extent.

INDUSTRIAL APPLICABILITY

As described above, the present invention provides a liquid-development electrophotographic apparatus using a nonvolatile, high-viscosity, high-concentration liquid toner and implementing the following features: a toner image transferred onto an intermediate transfer body is melted through application of heat at a contact portion between the intermediate transfer body and a printing medium to thereby melt-transfer the toner image onto the printing medium; excessive oil is removed from a toner layer which forms an image on the intermediate transfer body; and transmission of heat from a heated intermediate transfer belt to a photosensitive drum via an intermediate transfer roller is prevented.

What is claimed is:

1. A liquid-development electrophotographic apparatus, comprising a development section using a nonvolatile, high-viscosity, high-concentration liquid toner as a liquid developer, the development section being in contact with an image bearer body, on which an electrostatic latent image is formed, so as to supply the liquid developer onto the image bearer body, and causing toner particles contained in the liquid developer to adhere to the image bearer body according to an electric field established between the development section and the image bearer body to thereby form a toner image;

an intermediate transfer body to which the toner image is transferred from the image bearer body according to an electric field established between the same and the image bearer body; and a transfer-and-fixation section including a heater for melting the toner image transferred onto the intermediate transfer body through application of heat at a contact portion between the intermediate transfer body and a printing medium to thereby melt-transfer the toner image onto the printing medium, wherein the intermediate transfer body is equipped with a carrier-removing roller which comes into contact with a toner layer forming an image thereon in order to remove excessive oil from the toner layer and to which a bias voltage is applied in such a direction as to press toner particles against the intermediate transfer body retaining an image; and wherein a material having low surface energy is used as a surface material, serving as an image formation surface, of the intermediate transfer body, and an electric resistance of the surface material is set to a semiconductive range of 1E4-1E12 Ω, wherein after excessive oil is removed by means of the carrier-removing roller and before transfer onto printing paper is performed, an electric field is applied in a direction of transfer at such an intensity as not to effect transfer, thereby weakening a force of retaining toner on the image formation surface and thus realizing high efficiency of transfer onto the paper.

2. A liquid-development electrophotographic apparatus comprising a development section using a liquid toner as a developer, the development section being in contact with art image bearer body, on which art electrostatic latent image is formed, so as to supply the developer onto the image bearer body, and causing toner particles contained in the developer to adhere to the image bearer body according to an electric field established between the development section and the image bearer body to thereby form a toner image; art intermediate transfer section to which the toner image is transferred from, the image bearer body; and transfer and fixation section for melting the toner image transferred onto the intermediate transfer section through application of heat at a contact portion between the intermediate transfer section and a printing medium to thereby melt-transfer the toner image onto the printing medium, wherein the intermediate transfer section is equipped with an excessive-carrier-removing mechanism for removing excessive oil from a toner layer that forms en image on the intermediate transfer section; and wherein the excessive-carrier-removing mechanism comprises a semiconductive carrier-removing roller or belt which comes into contact with the toner layer heated to not lower than a melting temperature thereof or a temperature near the melting temperature and to which a bias voltage is applied in such a direction as to press toner particles against the intermediate transfer section retaining an image.

3. A liquid-development electrophotographic apparatus as described in claim 2, wherein the intermediate transfer section comprises a heat roller and an intermediate transfer belt looped around and mounted on the heat roller, for melting the transferred toner image through application of heat to thereby melt-transfer the toner image onto the printing medium; and a plurality of carrier-removing rollers are provided in such a manner as to abut the heat roller.

4. A liquid-development electrophotographic apparatus as described in claim 3, wherein a force which each of the plurality of carrier-removing rollers imposes on the intermediate transfer belt is set individually.

5. A liquid-development electrophotographic apparatus as described in claim 3, wherein a bias voltage with respect to the intermediate transfer belt to be applied to each of the plurality of carrier-removing rollers is set individually.

6. A liquid-development electrophotographic apparatus as described in claim 3, wherein hardness of each of the plurality of carrier-removing rollers is set individually.

7. A liquid-development electrophotographic apparatus as described in claim 3, wherein surface hardness of each of the plurality of carrier-removing rollers is set individually.

8. A liquid-development electrophotographic apparatus as described in claim 3, wherein the carrier-removing rollers are oriented such that polish grains of the rollers do not disturb an image.

9. A liquid-development electrophotographic apparatus as described in claim 4, wherein a force which each of the carrier-removing rollers imposes on the intermediate transfer belt is adjusted on the basis of analysis of a print pattern.

10. A liquid-development electrophotographic apparatus as described in claim 5, wherein a bias voltage to be applied to each of the carrier-removing rollers is adjusted on the basis of analysis of a print pattern.

11. A liquid-development electrophotographic apparatus as described claim 2, further comprising means for heating the carrier-removing roller and means for detecting temperature of the carrier-removing roller, so as to control the temperature of the carrier-removing roller at a constant level, thereby maintaining the carrier-removing roller at a constant electric resistance for stable carrier removal.

12. A liquid-development electrophotographic apparatus as described in claim 2, wherein the intermediate transfer section comprises an intermediate transfer roller for superposing toner images in a plurality of colors through transferring the toner images thereto from corresponding image bearer bodies, and an intermediate transfer belt having thereto superposed toner images transferred thereto at one time from tire intermediate transfer roller and functioning to melt the superposed toner images through application of heat at a contact portion between the same and a printing medium to thereby melt-transfer the superposed toner images onto the printing medium, and wherein time required to superpose the toner images in the plurality of colors on the Intermediate transfer roller Is utilized for controlling a speed of the intermediate transfer belt at the time of melt transfer within such a range as not to affect throughput.

13. A liquid-development electrophotographic apparatus as described in claim 12, wherein the speed of the intermediate transfer belt is controlled such that the intermediate transfer belt is rotated a plurality of times during a time between transfer of the toner images from the intermediate transfer roller to the intermediate transfer belt and melt transfer of the toner images onto the printing medium.

14. A liquid-development electrophotographic apparatus as described in claim 13, further comprising means for monitoring the number of rotations the intermediate transfer belt and changing a bias voltage to be applied to the carrier-removing roller, according to the number of rotations.

15. A liquid-development electrophotographic apparatus as described in claim 13, further comprising means for monitoring the number of rotations of the intermediate transfer belt and changing a force which the carrier-removing roller imposes on the intermediate transfer belt, according to the number of rotations.

16. A liquid-development electrophotographic apparatus as described in claim 2, wherein the intermediate transfer section comprises an intermediate transfer roller for superposing toner images in a plurality of colors through transferring the toner images thereto from corresponding image bearer bodies, and an intermediate transfer belt having the superposed toner images transferred thereto at one time from the transfer roller and functioning to melt the superposed toner images through application of heat at a contact portion between the same and a printing medium to thereby melt-transfer the superposed toner images onto the printing medium, and wherein a surface potential of the intermediate transfer belt retaining a heated toner layer is detected; an amount of residual carrier on the intermediate transfer belt is determined from a table describing a relation of the surface potential to the amount of residual carrier; and when the amount of residual carrier is large, the intermediate transfer belt is rotated two rotations.

17. A liquid-development electrophotographic apparatus as described in claim 16 wherein a plurality of carrier-removing rollers are provided in such a manner as to abut the intermediate transfer belt and such that the carrier-removing rollers can abut and retreat from the intermediate transfer belt independently of one another, and wherein the number of carrier-removing rollers abutting the transfer belt is-controlled according to the amount of residual carrier.

18. A liquid-development electrophotographic apparatus as described in claim 7, wherein the intermediate transfer section comprises at intermediate transfer roller for superposing toner images in a plurality of colors through transferring the toner images thereto from corresponding image bearer bodies, end an intermediate transfer belt having the superposed toner images transferred thereto at one time from the intermediate transfer roller and functioning to melt the superposed toner images through application of heat at a contact portion between the same and a printing h to thereby melt-transfer the superposed toner images onto the printing medium, and wherein a reflection-type optical sensor for detecting gloss whose incident angle of light reflection angle of light the same is provided on the intermediate transfer belt retaining the heated toner layer; an amount of residual carrier on the intermediate transfer belt is determined from a reflection output from the optical sensor; and when the amount of residual carrier is large, the intermediate transfer belt is rotated two rotations.

19. A liquid-development electrophotographic apparatus as described in claim 18, wherein a plurality of carrier-removing rollers are provided in such a manner as to abut the intermediate transfer belt and such that the carrier-removing rollers can abut and retreat from the intermediate transfer belt independently of one another, and wherein the number of carrier-removing rollers abutting the intermediate transfer belt is controlled according to the amount of residual carrier.

20. A liquid-development electrophotographic apparatus as described in claim 2, wherein in order to prevent a change in resistance of the carrier-removing roller caused by partial temperature rise of the carrier-removing roller, the carrier-removing roller is retreated from the intermediate transfer section when the carrier-removing roller faces a region other than a print region or when printing is not performed.

21. A liquid-development electrophotographic apparatus as described in claim 2, wherein the carrier-removing roller is caused to rotate, through contact with the intermediate transfer section, which is heated, to thereby be heated to a certain temperature through thermal conduction.

22. A liquid-development electrophotographic apparatus as described in claim 21, wherein a resistance of the carrier-removing roller calculated from voltage and current as measured when the voltage is applied between the camera-removing roller and the intermediate transfer section while the carrier-removing roller is in contact with the intermediate transfer section, and heating is controlled such that the resistance falls within a predetermined range.

23. A liquid-development electrophotographic apparatus as described in claim 2, wherein temperature of the carrier-removing roller or temperature of a last carrier-removing roller among a plurality of carrier-removing rollers is set higher than temperature of the intermediate transfer section.

24. A liquid-development electrophotographic apparatus as described in claim 2, wherein a bias voltage to be applied to the carrier-removing roller is changed according to the number of colors of toner images to be superposed on the intermediate transfer section.

25. A liquid-development electrophotographic apparatus as described in claim 2, wherein a bias voltage to be applied to the carrier-removing roller is controlled so as to limit current to a low level which does not cause variation in electric potential of the intermediate transfer section to thereby avoid influence or the variation on superposition transfer onto the intermediate transfer section.

26. A liquid-development electrophotographic apparatus as described in claim 2, wherein a blade for scraping off canter liquid from the carrier-removing roller has a plurality of protrusions projecting gravitationally downward so as to cause the carrier liquid collected at a blade tip to drip promptly.

* * * * *

UNITED STATES PATENT AND TRADEMARK OFFICE

CERTIFICATE OF CORRECTION

PATENT NO. : 6,745,002 B2
DATED : June 1, 2004
INVENTOR(S) : Yutaka Nakashima et al.

It is certified that error appears in the above-identified patent and that said Letters Patent is hereby corrected as shown below:

Column 22,
Lines 12 and 18, change “art” to -- an --;
Line 20, after “from” delete “,”, and after “and” insert -- a --;
Lines 20-21, change “transfer and fixation” to -- transfer-and-fixation --;

Column 23,
Line 18, change “thereto” to -- the --;
Line 19, change “tire” to -- the --;
Line 25, change “Intermediate” to -- intermediate -- and
change “Is” to -- is --;
Line 54, after “the” (first occurrence) insert -- intermediate --.

Column 24,
Line 4, after “the” insert -- intermediate --;
Line 5, change “is-controlled” to -- is controlled --;
Line 7, change “claim 7” to -- claim 2 --;
Line 11, change “end” to -- and --;
Line 15, delete “h” and insert -- medium --;
Line 19, after “light” insert -- are --;
Line 48, change “camera.” to -- carrier. --

Column 25,
Line 1, change “or” to -- of --;
Line 5, change “canter” to -- carrier --.

Signed and Sealed this

Seventeenth Day of May, 2005

JON W. DUDAS
*Director of the United States Patent and Trademark Office*